US012480306B2

(12) United States Patent
Morrow

(10) Patent No.: US 12,480,306 B2
(45) Date of Patent: Nov. 25, 2025

(54) METHOD FOR CONSTRUCTING BUILDING USING C-CHANNEL AND STANDARD AND TRANSITION PANELS

(71) Applicant: Blue Tomato, LLC, Provo, UT (US)

(72) Inventor: Brian D. Morrow, Provo, UT (US)

(73) Assignee: BLUE TOMATO, LLC, Provo, UT (US)

( * ) Notice: Subject to any disclaimer, the term of this patent is extended or adjusted under 35 U.S.C. 154(b) by 195 days.

(21) Appl. No.: 18/513,276

(22) Filed: Nov. 17, 2023

(65) Prior Publication Data

US 2024/0084587 A1 Mar. 14, 2024

Related U.S. Application Data

(63) Continuation-in-part of application No. 17/706,463, filed on Mar. 28, 2022, now Pat. No. 12,188,222, (Continued)

(51) Int. Cl.

| | |
|---|---|
| ***E04B 2/60*** | (2006.01) |
| ***E04B 5/10*** | (2006.01) |
| ***E04B 7/04*** | (2006.01) |

(52) U.S. Cl.

CPC ..... *E04B 2/60* (2013.01); *E04B 5/10* (2013.01); *E04B 7/04* (2013.01); *E04B 2103/04* (2013.01)

(58) Field of Classification Search

CPC ..... E04B 2/60

See application file for complete search history.

(56) References Cited

U.S. PATENT DOCUMENTS 2,202,783 A * 5/1940 Morrell ..... E04B 2/58 52/475.1

2,321,567 A 6/1943 Wilson (Continued)

FOREIGN PATENT DOCUMENTS

DE 3034601 A1 4/1982

FR 2359942 A1 2/1978

(Continued)

OTHER PUBLICATIONS

Ex Parte Quayle Action received for U.S. Appl. No. 29/648,685, mailed on Feb. 15, 2019.

(Continued)

*Primary Examiner* — Joshua K Ihezie

(74) *Attorney, Agent, or Firm* — Workman Nydegger

(57) ABSTRACT

Modular building methods and systems using precision machined modular panels. Standard modular panels can be used for constructing walls, floor, and roof, with transitions from wall-to-roof and wall-to-floor provided by special transition panels. All panels are pre-slotted to include a channel configured to receive flange(s) of a C-channel member. The present method progresses by assembly of a frame formed from C-channel frame members connected with overlap connections, followed by insertion of foam panels into flange(s) of the C-channel frame members, followed by insertion of another C-channel frame member into a slot on the opposite end of the panels, with such steps repeated, to form the building. Such alternating placement of panels and C-channel frame members eliminates the need for a tape measure, any independent frame for the building, and ensures the walls, floor, and roof are plumb.

17 Claims, 13 Drawing Sheets

Related U.S. Application Data which is a continuation-in-part of application No. 16/942,166, filed on Jul. 29, 2020, now Pat. No. 11,286,658, which is a continuation-in-part of application No. 16/824,209, filed on Mar. 19, 2020, now Pat. No. 11,352,775, which is a continuation-in-part of application No. 16/709,674, filed on Dec. 10, 2019, now Pat. No. 10,865,560.

(60) Provisional application No. 63/426,247, filed on Nov. 17, 2022, provisional application No. 63/278,042, filed on Nov. 10, 2021, provisional application No. 63/278,040, filed on Nov. 10, 2021, provisional application No. 62/991,889, filed on Mar. 19, 2020, provisional application No. 62/890,818, filed on Aug. 23, 2019, provisional application No. 62/777,648, filed on Dec. 10, 2018.

(56) References Cited

U.S. PATENT DOCUMENTS 2,844,848 A 7/1958 Couse et al.
3,236,014 A 2/1966 Norman
3,284,980 A 11/1966 Dinkel
3,310,917 A 3/1967 Simon
3,348,459 A * 10/1967 Harvey ..... E01C 9/083 404/35
3,353,315 A 11/1967 Barker
3,374,703 A 3/1968 Davis et al.
3,517,468 A 6/1970 Woods
3,529,390 A * 9/1970 Stetter ..... E04B 2/18 52/447
3,557,670 A * 1/1971 Sutton ..... E01C 9/083 244/114 R
3,646,715 A 3/1972 Pope
3,699,731 A 10/1972 Arnold
3,775,916 A 12/1973 Bair
3,808,085 A 4/1974 Givens
3,888,055 A 6/1975 Gallo
4,035,972 A 7/1977 Timmons
4,435,928 A * 3/1984 Huling, III ..... E04B 1/26 52/309.4
4,443,988 A * 4/1984 Coutu, Sr. ..... E04B 1/80 52/586.1
4,578,909 A * 4/1986 Henley ..... E04B 1/74 52/404.3
4,578,915 A 4/1986 Schneller
4,615,448 A 10/1986 Johnstonbaugh
4,617,219 A 10/1986 Schupack
4,641,468 A 2/1987 Slater
4,656,795 A * 4/1987 Albrecht ..... E04F 15/02435 52/800.1
4,676,036 A * 6/1987 Bessert ..... E04F 15/02452 52/126.6
4,774,794 A * 10/1988 Grieb ..... E04B 7/225 52/309.7
4,893,451 A 1/1990 Valente
4,944,416 A 7/1990 Petersen et al.
5,003,742 A * 4/1991 Dettbarn ..... E04B 2/7409 52/763
5,030,502 A 7/1991 Teare
5,062,387 A 11/1991 Anderson
5,121,578 A 6/1992 Holz
5,138,803 A 8/1992 Grossen
5,152,371 A * 10/1992 Wyse ..... E04G 1/12 182/119
5,172,532 A 12/1992 Gibbar, Jr.
5,173,233 A 12/1992 Kafarowski
5,181,353 A 1/1993 Harrington
5,231,813 A * 8/1993 Drawdy ..... E04C 2/288 52/251
5,268,226 A 12/1993 Sweeney
5,353,560 A * 10/1994 Heydon ..... E04B 7/22 52/592.1
5,353,562 A * 10/1994 Decker ..... E04C 2/205 52/309.7
5,377,470 A 1/1995 Hebinck
5,390,462 A 2/1995 Kreiter
5,403,062 A * 4/1995 Sjostedt ..... B65D 90/0026 296/181.6
5,505,031 A * 4/1996 Heydon ..... E04B 1/7654 52/800.1
D384,108 S 9/1997 Rinicella et al.
5,694,730 A 12/1997 Del et al.
5,803,964 A * 9/1998 Scarborough ..... E04B 1/161 106/737
5,822,940 A * 10/1998 Carlin ..... E04B 2/7453 52/459
5,899,037 A 5/1999 Josey
5,901,522 A 5/1999 Slater
5,921,046 A 7/1999 Hammond, Jr.
5,927,032 A * 7/1999 Record ..... E04C 2/288 52/412
5,950,389 A * 9/1999 Porter ..... E04C 2/296 403/DIG. 15
6,035,594 A 3/2000 Leslie
D444,577 S 7/2001 Neuhofer, Jr.
6,305,135 B1 10/2001 Inaba
6,324,809 B1 12/2001 Nelson
6,460,302 B1 * 10/2002 Neuhaus, III ..... E04B 1/161 52/261
6,470,632 B1 10/2002 Smith
6,481,172 B1 * 11/2002 Porter ..... B32B 5/18 52/794.1
6,571,523 B2 6/2003 Chambers
D477,423 S 7/2003 Campbell et al.
6,694,689 B1 * 2/2004 Scott ..... H02G 3/385 52/460
6,701,683 B2 3/2004 Messenger et al.
6,772,890 B2 8/2004 Campbell et al.
6,985,832 B2 * 1/2006 Saebi ..... G06F 30/13 702/183
D519,651 S 4/2006 Simic
7,028,440 B2 * 4/2006 Brisson ..... E04C 2/288 52/439
7,036,196 B2 5/2006 Salatin et al.
7,093,726 B1 8/2006 Holztrager
7,165,374 B2 * 1/2007 Ohanesian ..... B28B 11/042 52/424
D569,013 S 5/2008 Shuman et al.
7,712,265 B2 5/2010 Overmyer et al.
7,779,600 B1 * 8/2010 Saebi ..... E04B 1/18 52/309.1
7,877,960 B2 * 2/2011 Kennedy ..... E04C 2/384 52/592.1
7,913,730 B2 3/2011 Schaffeld
8,151,539 B2 * 4/2012 Grinsted ..... E04C 2/205 52/745.1
8,220,648 B2 7/2012 Barkdoll et al.
8,468,767 B1 6/2013 Mcbride
8,627,625 B2 1/2014 Bouchard et al.
8,695,299 B2 4/2014 Propst
9,234,355 B2 1/2016 Sealock et al.
D861,194 S * 9/2019 Morrow ..... D25/138
10,450,736 B2 10/2019 Morrow
10,487,499 B1 * 11/2019 Berkowitz ..... E04B 2/7425
10,865,560 B1 * 12/2020 Morrow ..... E04B 2/16
10,988,931 B1 * 4/2021 McManus ..... E04F 15/082
11,015,340 B2 5/2021 Morrow
11,286,658 B2 3/2022 Morrow
11,352,775 B2 * 6/2022 Morrow ..... E04B 1/02
11,401,724 B2 8/2022 Morrow
11,697,946 B2 7/2023 Morrow
D994,148 S 8/2023 Morrow
11,821,206 B2 * 11/2023 Leahy ..... E04C 2/526
12,188,222 B2 1/2025 Morrow
2004/0067373 A1 * 4/2004 Kennedy ..... B32B 15/08 428/457
2005/0284060 A1 12/2005 Ritchie
2006/0046068 A1 3/2006 Barancyk et al.

(56) References Cited

U.S. PATENT DOCUMENTS

| | | | | |
|---|---|---|---|---|
| 2006/0207479 | A1 | 9/2006 | Hughes | |
| 2007/0113501 | A1* | 5/2007 | Ohanesian | E04H 17/1404 52/468 |
| 2007/0131308 | A1* | 6/2007 | Martin | E04C 2/386 144/344 |
| 2007/0163197 | A1* | 7/2007 | Payne | E04B 1/14 52/287.1 |
| 2008/0282632 | A1 | 11/2008 | Sleeman | |
| 2009/0100780 | A1* | 4/2009 | Mathis | E04C 2/296 52/794.1 |
| 2009/0205277 | A1* | 8/2009 | Gibson | E04D 13/1625 52/656.1 |
| 2010/0011699 | A1* | 1/2010 | Weimer | E04C 2/52 52/745.1 |
| 2010/0083590 | A1 | 4/2010 | Wochnik | |
| 2010/0095625 | A1 | 4/2010 | Boutaghou et al. | |
| 2010/0136269 | A1 | 6/2010 | Andersen et al. | |
| 2011/0067331 | A1* | 3/2011 | Grinsted | E04B 1/14 52/309.4 |
| 2011/0173911 | A1* | 7/2011 | Propst | B32B 13/045 427/403 |
| 2011/0214374 | A1 | 9/2011 | Propst | |
| 2012/0011793 | A1 | 1/2012 | Clark et al. | |
| 2013/0008129 | A1 | 1/2013 | Hall | |
| 2013/0086850 | A1 | 4/2013 | Morrow | |
| 2013/0216760 | A1 | 8/2013 | Bol | |
| 2013/0227902 | A1* | 9/2013 | Van Sloun | B32B 5/18 264/261 |
| 2013/0266370 | A1 | 10/2013 | Gunther | |
| 2014/0250827 | A1 | 9/2014 | Gillman | |
| 2015/0135634 | A1* | 5/2015 | Hoie | E04C 2/243 52/745.05 |
| 2016/0014995 | A1 | 1/2016 | Bruno | |
| 2016/0208489 | A1* | 7/2016 | Gibson | E04B 1/14 |
| 2017/0096825 | A1 | 4/2017 | Bree | |
| 2017/0121958 | A1 | 5/2017 | Jin | |
| 2017/0211268 | A1 | 7/2017 | Eichhorn et al. | |
| 2018/0298600 | A1* | 10/2018 | Moss | E04B 1/388 |
| 2019/0242109 | A1* | 8/2019 | Morrow | E04B 2/562 |
| 2020/0001583 | A1 | 1/2020 | Eichhorn et al. | |
| 2020/0354945 | A1 | 11/2020 | Morrow | |
| 2021/0040722 | A1 | 2/2021 | Morrow | |
| 2021/0040733 | A1 | 2/2021 | Morrow | |
| 2021/0040759 | A1 | 2/2021 | Morrow | |
| 2021/0207375 | A1* | 7/2021 | Leahy | E04C 2/526 |
| 2021/0301528 | A1 | 9/2021 | Dombowsky et al. | |
| 2022/0220728 | A1 | 7/2022 | Morrow | |
| 2023/0009162 | A1 | 1/2023 | Morrow | |
| 2025/0137266 | A1 | 5/2025 | Morrow | |

FOREIGN PATENT DOCUMENTS

| | | | |
|---|---|---|---|
| GB | 2261234 | A | 5/1993 |
| JP | 07-102680 | A | 4/1995 |
| JP | 10-148095 | A | 6/1998 |
| JP | 2002-292612 | A | 10/2002 |
| KR | 10-1993-0010328 | A | 6/1993 |
| KR | 10-2009-0065909 | A | 6/2009 |
| WO | 2013/052427 | A2 | 4/2013 |
| WO | 2018/194528 | A1 | 10/2018 |
| WO | 2021/118744 | | 6/2021 |

OTHER PUBLICATIONS

Final Office Action received for U.S. Appl. No. 13/436,403, mailed on Aug. 1, 2013.
Final Office Action received for U.S. Appl. No. 16/549,901, mailed on Mar. 12, 2021, 6 pages.
International Search Report for PCT/US2012/058344 mailed Mar. 28, 2013,3 pages.
Non-Final Office Action received for U.S. Appl. No. 16/549,901, mailed on Sep. 4, 2020.
Non-Final Office Action received for U.S. Appl. No. 16/824,209, mailed on Jul. 29, 2021, 13 pages.
Non-Final Office Action received for U.S. Appl. No. 17/465,666, mailed on Nov. 25, 2022, 10 pages.
Notice of Allowance received for U.S. Appl. No. 13/866,569, mailed on Jun. 20, 2014.
Notice of Allowance received for U.S. Appl. No. 16/549,901, mailed on Apr. 16, 2021, 8 pages.
Notice of Allowance received for U.S. Appl. No. 16/824,209, mailed on Jan. 20, 2022, 8 pages.
Notice of Allowance received for U.S. Appl. No. 16/942,166, mailed on Nov. 23, 2021, 8 pages.
Notice of Allowance received for U.S. Appl. No. 17/465,666, mailed on Feb. 27, 2023, 7 pages.
Notice of Allowance received for U.S. Appl. No. 29/648,685, mailed on May 9, 2019.
Notice of Allowance received for U.S. Appl. No. 29/744,477, mailed on Mar. 20, 2023, 9 pages.
Office Action received for U.S. Appl. No. 16/653,579, mailed on Feb. 25, 2022, 8 pages.
Office Action received for U.S. Appl. No. 13/436,403, mailed on Feb. 13, 2013.
Office Action received for U.S. Appl. No. 15/426,756, mailed on Feb. 23, 2018.
Office Action received for U.S. Appl. No. 15/987,366, mailed on Feb. 14, 2019.
Office Action received for U.S. Appl. No. 16/709,674, mailed on Apr. 6, 2020.
Restriction Requirement received for U.S. Appl. No. 29/744,477, mailed on Nov. 30, 2022, 6 pages.
U.S. Application filed on Apr. 19, 2013 by Morrow., U.S. Appl. No. 13/866,569.
U.S. Application filed on Aug. 23, 2019. by Morrow., U.S. Appl. No. 16/549,901.
U.S. Application filed on Feb. 7, 2017 by Morrow., U.S. Appl. No. 15/426,756.
U.S. Application filed on Jul. 31, 2018, by Morrow., U.S. Appl. No. 29/658,417.
U.S. Application filed on Mar. 19, 2020 by Morrow., U.S. Appl. No. 16/824,209.
U.S. Application filed on May 23, 2018, by Morrow., U.S. Appl. No. 29/648,685.
U.S. Appl. No. 16/653,579, filed Oct. 15, 2019.
U.S. Appl. No. 13/436,403, filed Mar. 30, 2012.
U.S. Appl. No. 62/722,591, filed Aug. 24, 2018.
U.S. Appl. No. 62/890,818, filed Aug. 23, 2019.
U.S. Appl. No. 62/991,889, filed Mar. 19, 2020.
U.S. Appl. No. 16/942,166, filed Jul. 29, 2020.
U.S. Appl. No. 29/744,477, filed Jul. 29, 2020.
Non-Final Office Action received for U.S. Appl. No. 17/706,463, mailed on May 31, 2024, 12 pages.
Notice of Allowance received for U.S. Appl. No. 17/706,463, mailed on Sep. 11, 2024, 9 pages.

* cited by examiner

METHOD FOR CONSTRUCTING BUILDING USING C-CHANNEL AND STANDARD AND TRANSITION PANELS

CROSS-REFERENCE TO RELATED APPLICATION

The present application claims priority to, and the benefit of U.S. Patent Application No. 63/426,247 (18944.25) filed Nov. 17, 2022. The present application also is a continuation-in-part of U.S. patent application Ser. No. 17/706,463 (18944.18.7) filed Mar. 28, 2022, which is a continuation-in-part of U.S. patent application Ser. No. 16/942,166 (18944.18.5) (now U.S. Pat. No. 11,286,658), filed Jul. 29, 2020, which is a continuation-in-part of U.S. patent application Ser. No. 16/824,209 (18944.18.3) (now U.S. Pat. No. 11,352,775) filed Mar. 19, 2020, which claims priority to and the benefit of U.S. Provisional Patent Application No. 62/991,889 (18944.18.4), filed Mar. 19, 2020. Application Ser. No. 16/824,209 is also a continuation-in part of U.S. patent application Ser. No. 16/709,674 (18944.18.2) (now U.S. Pat. No. 10,865,560) filed Dec. 10, 2019, which claims priority to and the benefit of United States Provisional Patent Application Nos. 62/777,648 (18944.18) and 62/890,818 (18944.18.1), filed Dec. 10, 2018 and Aug. 23, 2019, respectively. application Ser. No. 17/706,463 (18944.18.7) also claims the benefit of United States Provisional Patent Application Nos. 63/278,040 (18944.23) and 63/278,042 (18944.24), both filed Nov. 10, 2021. Each of the foregoing applications is herein incorporated by reference in its entirety.

The present application also incorporates by reference U.S. Patent Application No. 63/273,044 (18944.18.6) filed Oct. 28, 2021.

BACKGROUND OF THE INVENTION

1. The Field of the Invention

The present invention is in the field of modular building construction methods and systems used within the construction industry.

2. The Relevant Technology

Building construction systems including modular features are sometimes used in the construction field. For example, particularly in third world countries where skilled labor is not readily available, and building materials must be relatively inexpensive, cinder block or brick materials are used in constructing homes, schools, agricultural buildings, and other buildings. It can be difficult to learn to lay block or brick while keeping the walls square and plumb. In addition, such systems require mortar to hold the individual blocks or bricks together. A roof formed from a different material (other than block or brick) is needed. In addition, insulating and/or providing an air-tight seal (e.g., to employ negative pressurization) within such structures is difficult.

Stick frame construction methods are of course also well known, although such systems also require a considerable amount of skilled labor to construct a building therefrom. In addition to requiring skilled labor, such existing methods also require considerable strength for those involved in the construction. Because of such requirements, in practice, such construction systems are not readily usable by groups of both men and women, where women often make up the vast majority of the labor pool available in third world humanitarian construction projects.

Various other building materials and systems are also used in the art. Structural insulated panels (SIPs) are used in some circumstances within the construction industry as an alternative to stick frame construction with insulation blown or laid within the cavities between stick framing members. A typical structural insulated panel may include an insulating layer sandwiched between two layers of structural plywood or oriented strand board ("OSB"). The use of such panels within residential, commercial or other construction projects can often significantly decrease the time required for construction, and also typically provides superior insulating ability as compared to a traditional structure constructed of block or brick, or even stick frame construction with insulation blown or laid between frame members. That said, drawbacks with such systems include that stick frame construction and SIP construction typically require some level of skilled labor, and thus are not particularly well suited for use in environments where such skills are not readily available, and shipping such panels can represent a significant expense. In addition, heavy equipment (e.g., cranes) are often required to install such panels, as well as other components (e.g., frame members).

SUMMARY

According to an embodiment, one aspect of the invention relates to a method for constructing a building from a plurality of C-channel frame members, a plurality of standard modular wall panels, a plurality of wall-to-floor transition panels, and a plurality of wall-to-roof transition panels. Such a method is simple, and includes the following steps: (i) laying down a floor or skirt; (ii) forming a first frame (e.g., an endwall) at least partially defining the floor, a wall, and a roof, the first frame comprising or being formed from a plurality of C-channel frame members; (iii) sliding pre-slotted standard foam wall panels, pre-slotted wall-to-floor transition foam panels, and pre-slotted wall-to-roof transition foam panels into flanges of the C-channel frame members of the first frame; (iv) forming a second frame also at least partially defining the floor, the wall, and the roof, the second frame being formed by inserting a plurality of C-channel frame members into an opposite end of the pre-slotted standard wall foam panels, pre-slotted wall-to-floor transition foam panels, and pre-slotted wall-to-roof transition foam panels; and (v) repeating the above steps (ii)-(iv), as desired, to construct the building (e.g., in one 4-foot module section after another).

In an embodiment, the first frame may define an endwall of the building.

In an embodiment, standard panels identical or substantially similar to those used for the walls, can also be used for the floor, and/or roof.

In an embodiment, the C-channel frame members are placed back-to-back, forming I-beams between adjacent module sections of the building. Providing such I-beams as two C-channel members, which are placed back-to-back, rather than providing an integral I-beam, eases handling and placement of the frame member components (each component is only half the weight, as it would otherwise be, if integral I-beams were used).

In an embodiment, the pre-slotted foam panels include channel(s) extending along their length or width, flange(s) of the C-channel frame members being engaged therein. In an embodiment, both flanges of the C-channel frame member are engaged in such channels. In another embodiment, only one flange-receiving channel is provided in each panel side or edge, and the non-engaged flange of the C-channel frame members wrap around a corner edge of the pre-slotted foam panels.

In an embodiment, a space between the flanges of the C-channel frame members is filled with a body of the pre-slotted foam panels, ensuring that forces applied to the panels place that portion of the panel in between the flanges of the C-channel frame member in compression, rather than in tension.

In an embodiment, the top and bottom ends of the pre-slotted foam panels include a stair stepped or inclined configuration, so that when stacking one pre-slotted foam panel atop or adjacent another pre-slotted foam panel, a substantially horizontal or vertical seam therebetween is defined by an inclined or stair-stepped surface interior to the seam, so as to minimize or prevent water seepage between stacked pre-slotted foam panels. By way of example, the walls may include horizontal seams, while the floor ma include vertical seams. The seams between roof panels may be vertical, or of a wide variety of angles, depending on roof pitch or slant.

In an embodiment, the C-channel frame members include alignment holes formed therein, the alignment holes becoming aligned when the C-channel frame members are properly aligned with one another, to form the first frame and the second frame. In particular, an alignment hole in a C-channel frame member of the first frame may align with an alignment hole in a C-channel frame member of the second frame, where the C-channel frame members form overlapping connections between one another. The alignment holes help those building the building to easily and quickly verify that the components of the frame have been correctly positioned, before attaching the frame members to one another, and proceeding to the next step.

The present invention provides numerous advantages, some of which are described very briefly below.

Using the present method, it took Applicant 6 hours to assemble a small pool house.

The steps, and the order of the steps are key to achieving such a fast assembly result.

The foam panels are cut to be extremely accurate (as they are cut on a CNC machine).

The method proceeds by constructing sections of the building, by taking a profile "slice" through the building, and constructing each 4 foot (or other width) section one after the other.

One can start with an endwall, which can be supported.

Slide the foam over the endwall (e.g, the pre-slotted channels of the foam panels are inserted into the flanges of the endwall frame wall.

Especially for larger buildings, one may use a method where one assembles the entire floor of a given level first, where vertically projecting "stubs" are provided, sticking up from the floor, for attachment to the frame members (e.g., particularly the vertical frame members of the walls).

Build sections of the floor, with vertical stubs.

Similar overlap joints can be provided adjacent the floor, as have been described in Applicant's previous applications, already incorporated by reference.

The stubs engage with the floor-to-wall transition panels.

Build the floor first. This makes it much easier, as one can reach what one needs to reach, with the floor in place.

Opposing C-channel frame members (positioned back-to-back) can be pre-glued or screwed or otherwise pre-fastened together, for use as floor stubs. Such floor stubs may be relatively short, e.g., 3 feet or less, 2 feet or less, or 18 inches or less.

Horizontal C-channel members (used for the floor) can be of the same length, offset relative to one another (so that one C-channel member sticks out one end, and the other C-channel member, sticks out the other end). The offset may be equal to the width of the wall's vertical C-channel member.

This offset forces the vertical and top (e.g., roof) C-channel members to also be correctly offset, based on the offset provided with the stubs.

A gap may be provided between the stub and the rest of the vertical C-channel member to accommodate placement of the floor panel (e.g., floor-to-wall transition panel).

Assembling the full floor first is a big help.

Overlap joints provided at each intersection are very strong.

The use of the stubs makes "plumbing" the vertical member much easier. The longer pieces are more difficult to plumb. Use of stubs helps.

Holes (e.g., roll formed holes) in the C-channel members align with one another, to ensure that all overlap joints are properly made.

Build 1 module at a time.

The precision machined foam panels are used as a jig to get the steel C-channel members in the right place.

Assemble the floor first, then build the remainder of each e.g., 4-foot module.

Each module "slice" could be flat-packed on a pallet. The parts can be packed on the pallet in the reverse order they are installed, so they get pulled off the pallet in the order needed.

Applicant is essentially "3D printing" a house in 4-foot sections, floor by floor.

Each piece placed forces the next piece to be aligned and positioned correctly.

The method eliminates any need for separate reinforcing or attachment brackets. Brackets are replaced with overlap joints.

All intersections of the C-channel frame members of the roof frame members, lateral frame members, etc. have the overlap.

The steel C-channel and foam panels align one another.

For a small building (e.g., 8×12 pool house or the like), a skirt can be provided. First step is to either place the skirt (e.g., leveled) or assemble the floor. The skirt provides a location to screw into.

Step 1—lay down floor (or skirt)

Step 2—start with ½ frame (C-channel frame members) that partially defines the floor, wall, and roof.

Step 3—insert foam (wall panels, floor panels, transition panels).

Step 4—insert next ½ of steel C-channel frame member.

Step 5—repeat.

If the building is small, no stubs are needed in the floor. The stubs simply help with plumbing larger length vertical members, and ensuring proper overlap joints are made.

In an embodiment (e.g., where stubs are employed), it can be helpful to start with one of the frame members that is not an endwall (that includes back-to-back C-channel frame members).

The stub is rigid because it is short, and anchored into the floor C-channel frame member(s).

Flat pack is also helpful.

Use of a low-pressure low velocity furnace is particularly useful with such a system.

One can create an opening into a plenum that can be pre-formed in the floor or roof transition panels. Such a plenum can be provided in the transition panels (floor-to-wall and wall-to-roof transition panels), creating a plenum that runs along the length of the floor and/or roof. Such a plenum pre-formed into the panels can eliminate or reduce any need for separate HVAC ducting.

It is also possible to add various specific functions into the transition panels (as they are already different from the standard wall and floor panels anyway).

Low volume ducting can be used to connect plenums, if desired.

One can caulk or apply adhesive around the plenum, when connecting one module to the next.

Greatly simplifies HVAC work.

Plenum is in the thermal break portion of the panel.

Electrical cabling can be run in a cable raceway pre-formed within the wall-to-floor transition panel, along the exterior of the wall-to-floor transition panel.

3rd parties can provide a module with particular functionality, compatible with Applicant's SIMPLYBILT system (e.g., heating, electrical, plumbing, fireplace, windows, doors, etc.).

Such functionality panels can replace 1 or more standard and/or transition panels. Such 3rd parties can provide any functionality they want in the "middle" of such a system, so long as the ends where the functional module joins to the next module or panel is the same as provided in the standard module and panels. All that matters is the edges, where such a system connects to adjacent panels. A 3rd party can provide any desired functionality in the middle of such a "plug and play" system.

There can be a digital warehouse of modules that are compatible with Applicants' SIMPLYBILT system, provided by 3rd parties, for use in design of any building desired.

Metal C-channel frame members go in one at a time (not as a fully assembled frame, or even an assembled I-beam). It is far lighter and easier to handle this way.

Push the splines/furring strips in prior to placement of the steel C-channel member.

In an embodiment, a slot can be provided in the panel for rack attachment to the C-channel.

The transitions are what makes this system work.

The claimed process is essentially a 4-step process:

(1) lay down floor or skirt;

(2) start with the ½ frame that partially defines the floor, wall and roof (install each member for this);

(3) insert the foam, into the flanges of the frame members from (2); and (4) insert the next half of the frame. (Then repeat steps 2-4 again).

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The drawings illustrate several embodiments of the invention, wherein identical reference numerals refer to identical or similar elements or features in different views or embodiments shown in the drawings.

Various other modular panels that may be used, or modifications thereof, are described in Applicant's applications already incorporated herein by reference.

Figure 5:
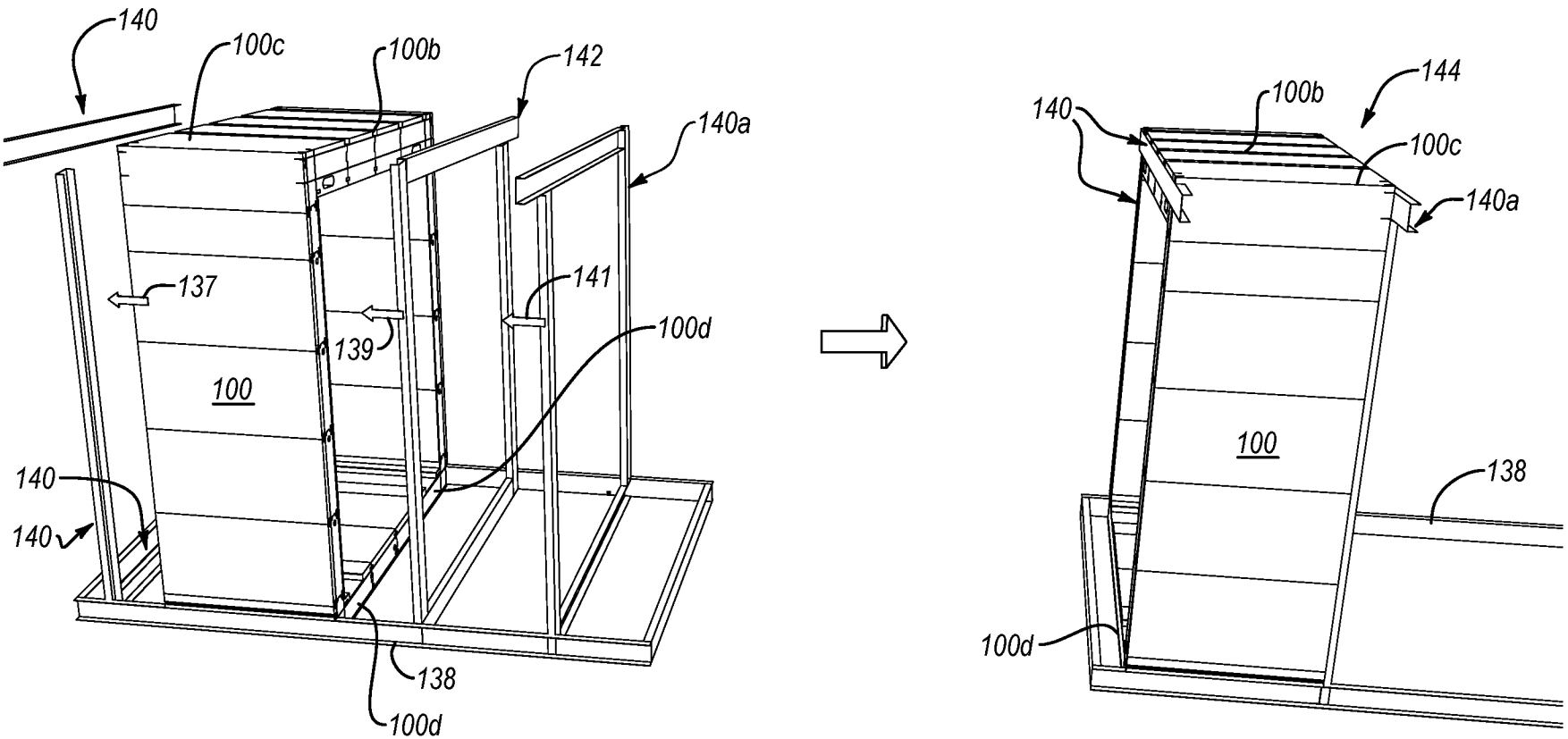

FIG. 5 illustrates the simple process of the present invention, by which a floor or skirt is provided, a first frame is formed from C-channel frame members, the various pre-slotted foam panels are slid into the flange(s) of the C-channel frame members, a second frame is formed over the pre-slotted foam panels by inserting flange(s) of the C-channel frame members into the opposite end of the pre-slotted foam panels, and the process of positioning alternating C-channel frame members and panels is repeated, to build the building construction one "slice" at a time.

Figure 6:
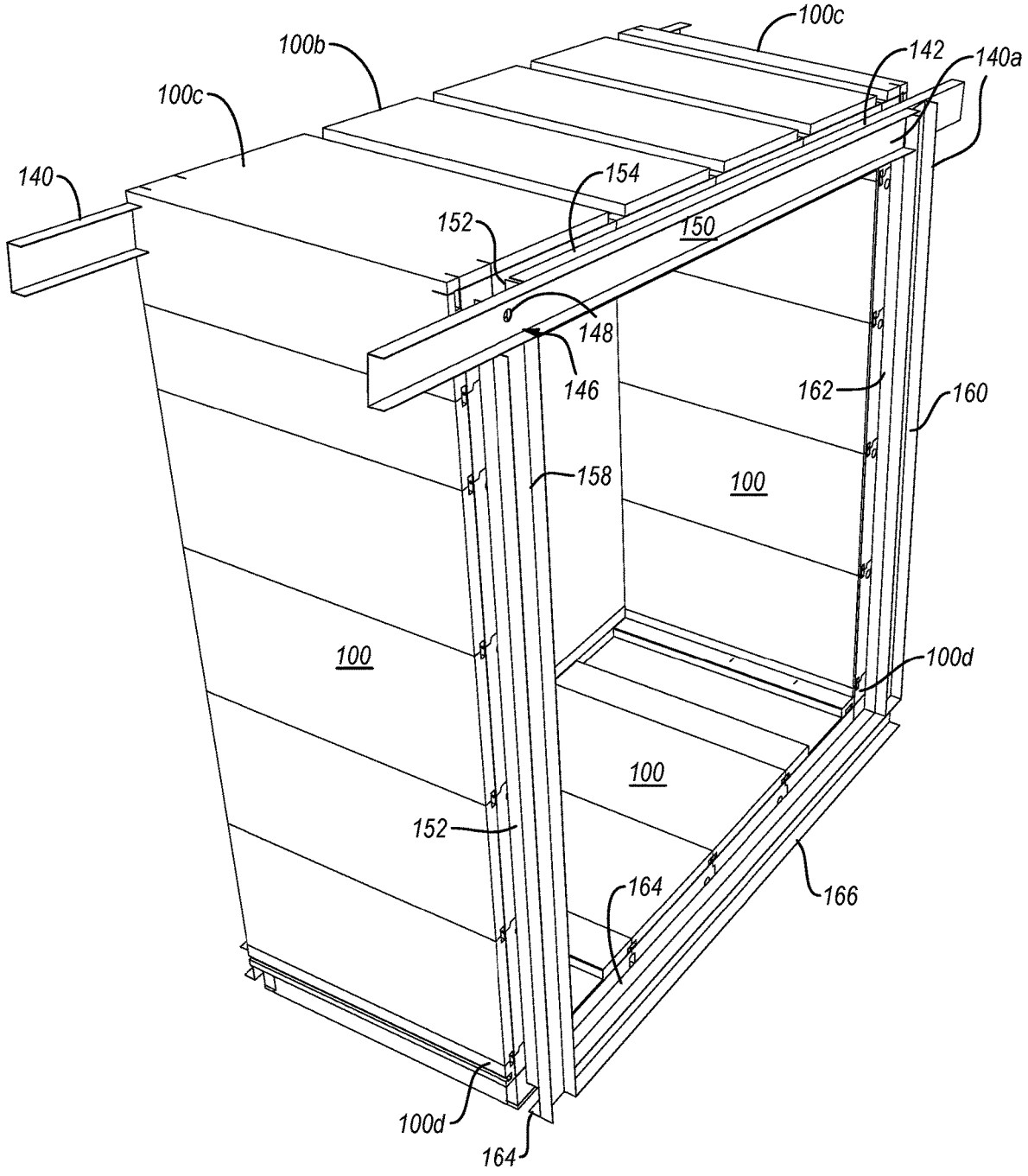

FIG. 6 illustrates the assembled first "slice", resulting from the method shown in conjunction with FIG. 5.

Figure 7A:
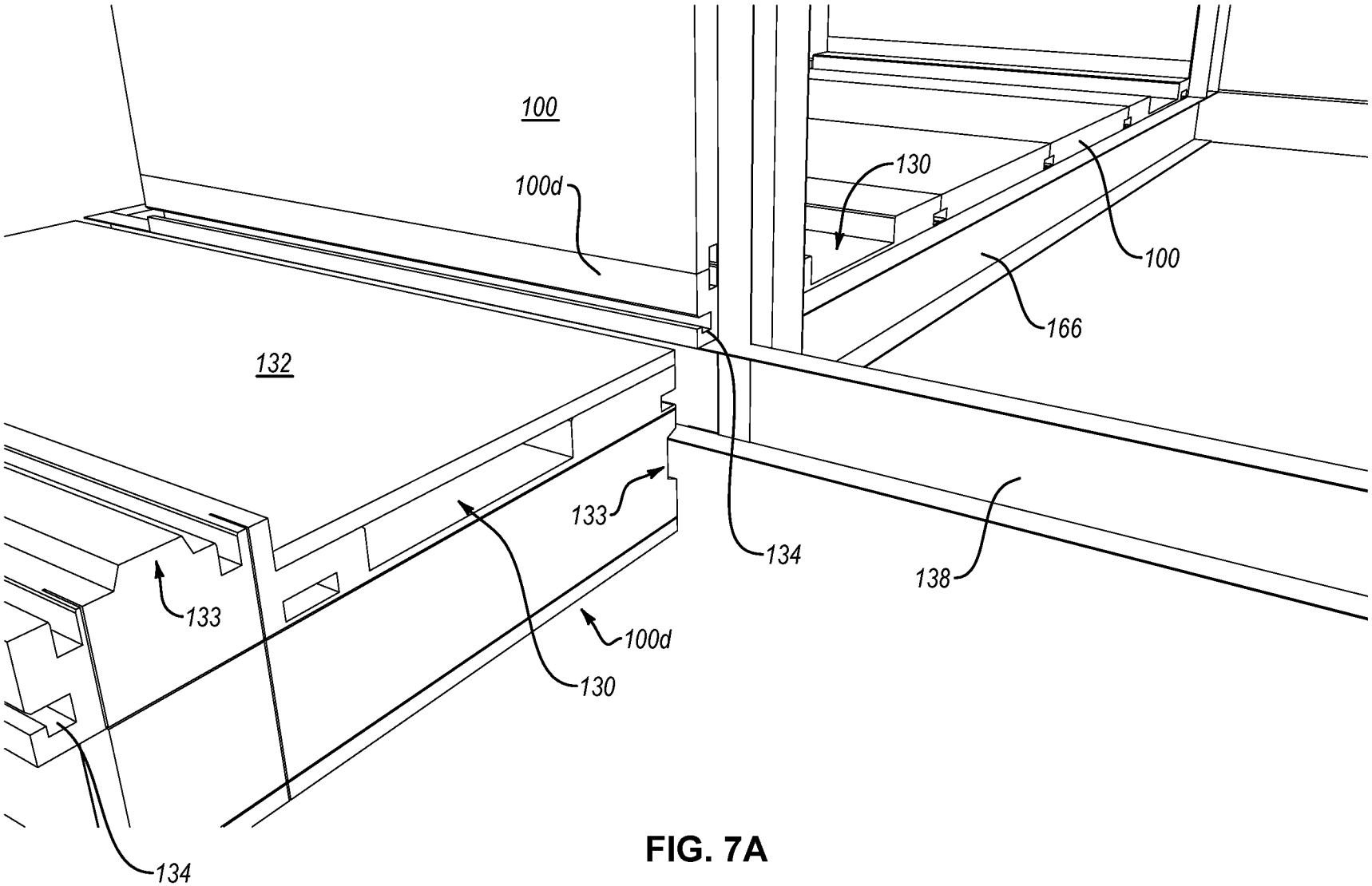

FIG. 7A shows a close-up view of the floor and wall-to-floor transition panels portion of the assembled "slice" shown in FIG. 6, also showing an additional separated wall-to-floor transition panel, with OSB sheathing placed thereover, showing features thereof.

Figure 7B:
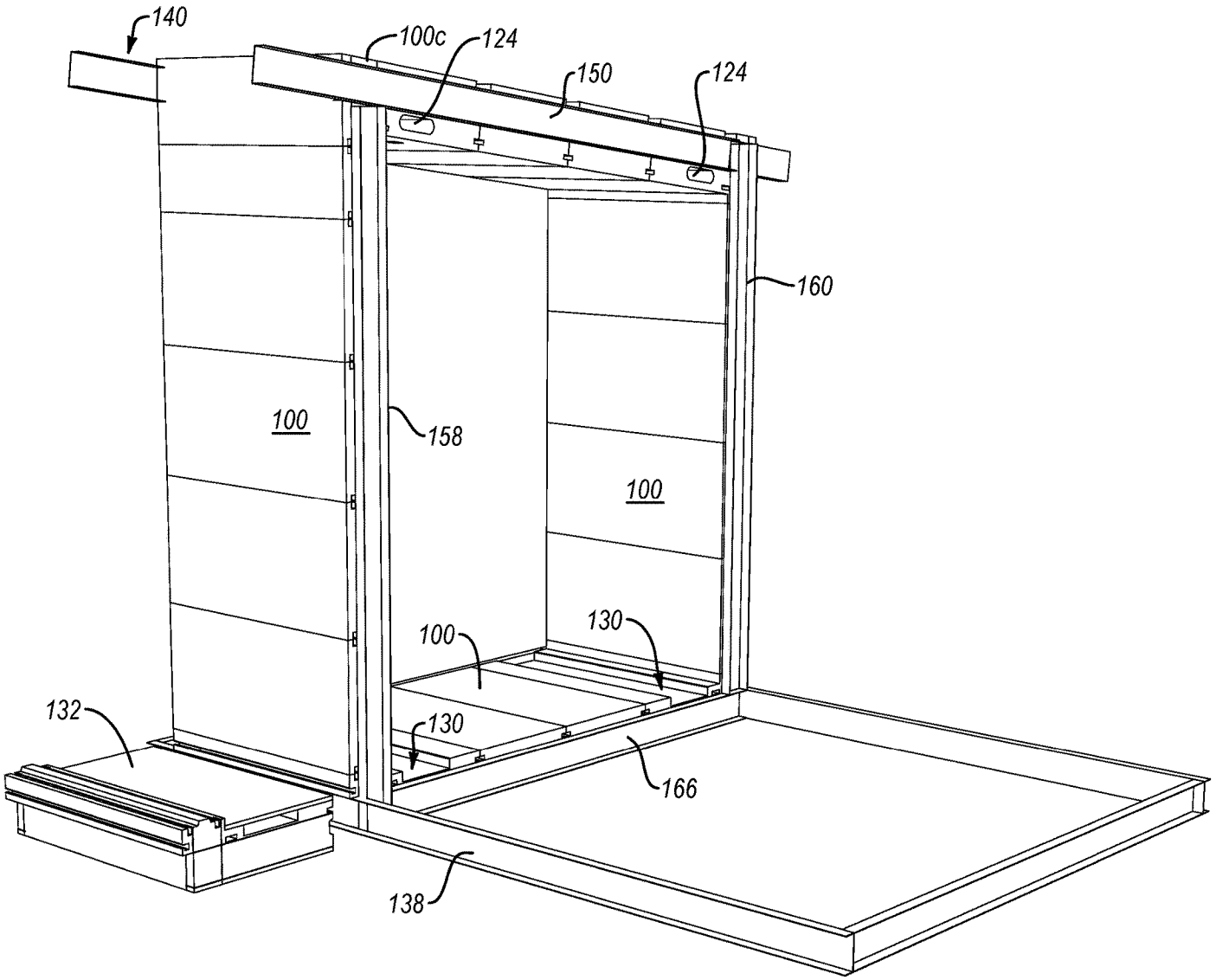

FIG. 7B shows the full zoomed-out view of the "slice" shown in FIG. 7A.

Figure 7C:
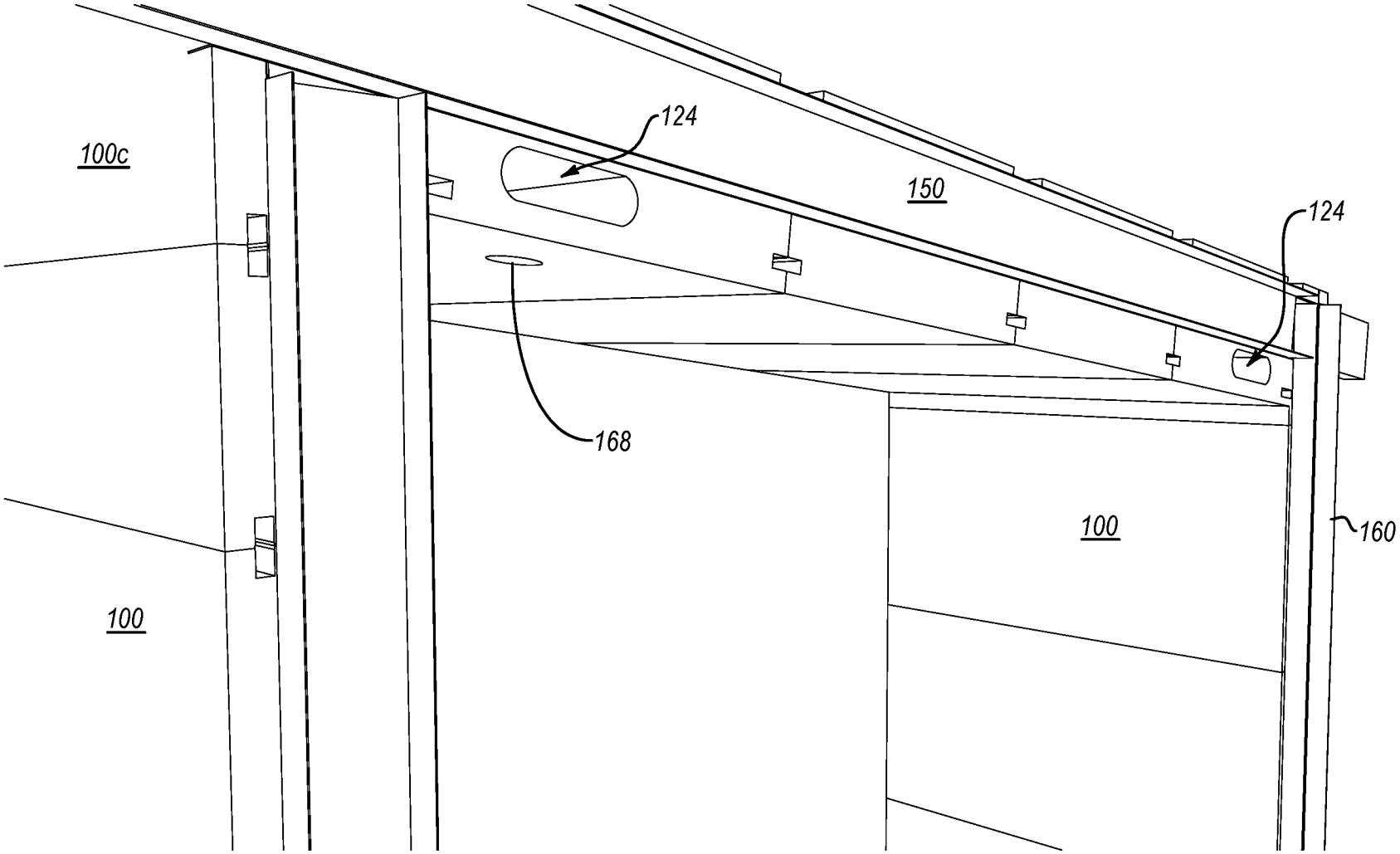

FIG. 7C shows a close-up view of the roof and wall-to-roof transition panels portion of the assembled "slice" of FIG. 7B.

Figure 8:
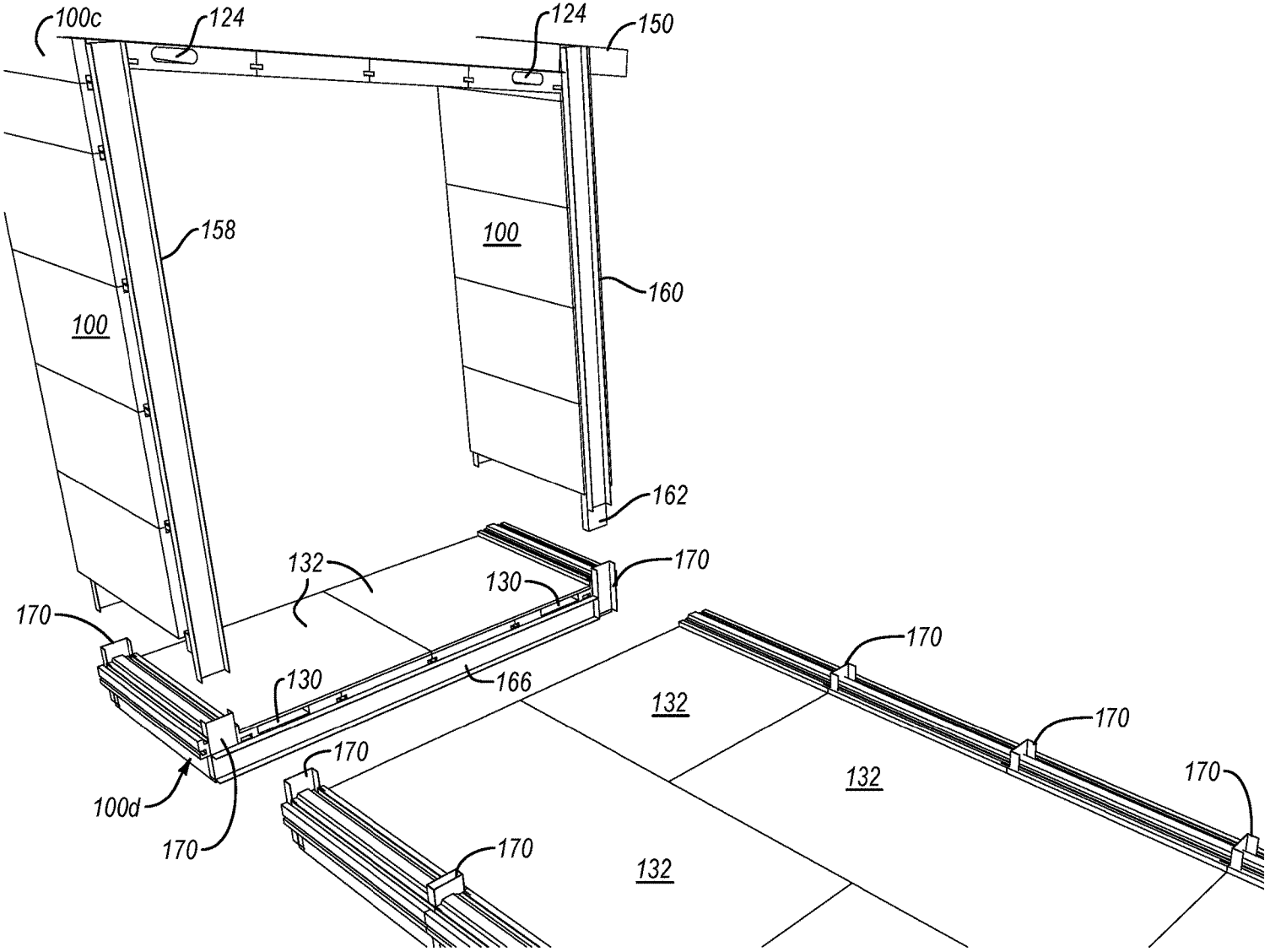

FIG. 8 shows how vertically projecting "stubs" can be provided, sticking up from the floor, for overlapping attachment to the vertical C-channel frame members. FIG. 8 also shows OSB sheathing placed over the floor panels.

Figure 9:
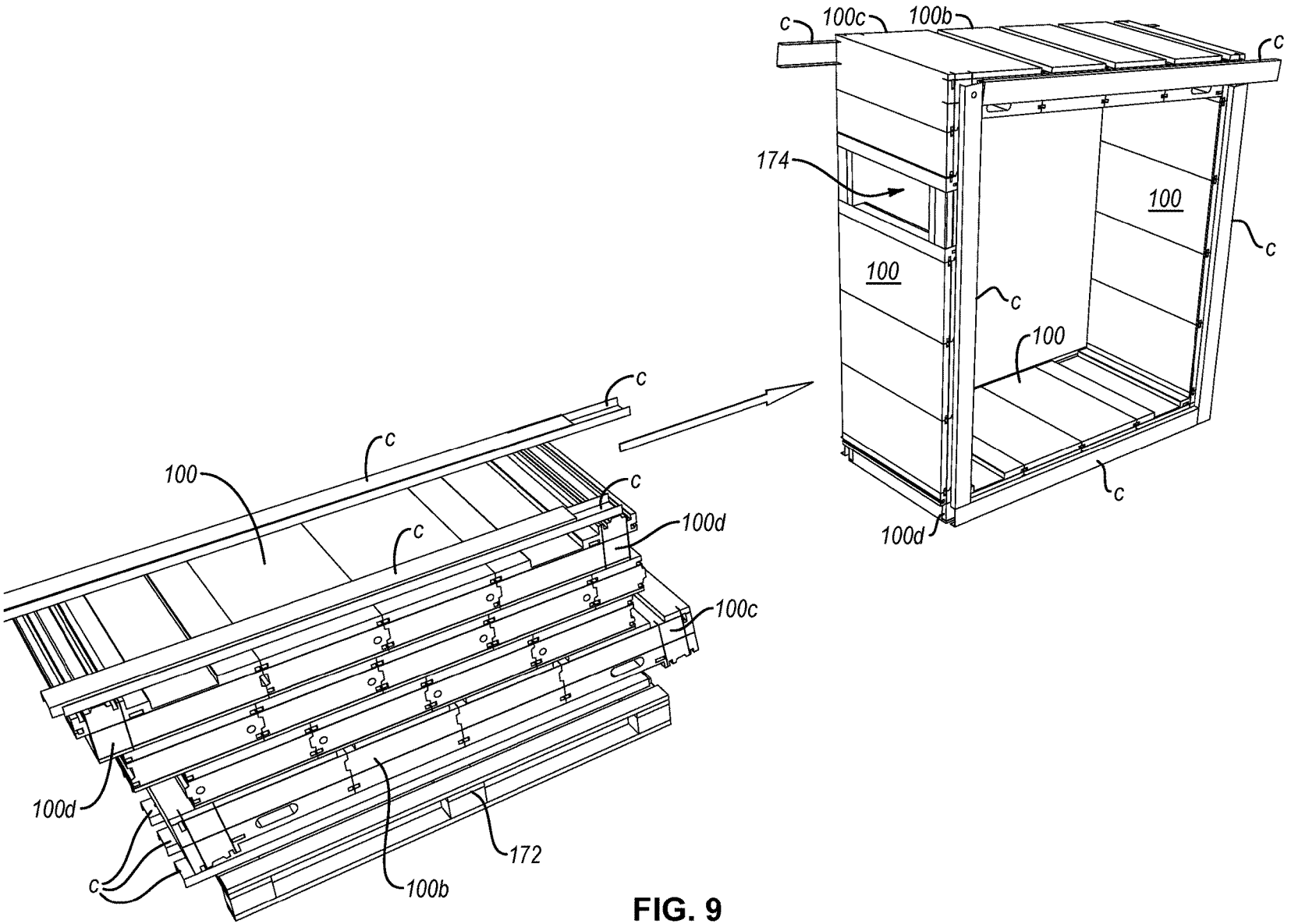

FIG. 9 shows how the various foam panels and C-channel frame members can be flat-packed on a pallet, for easy assembly of a given "slice" of the building construction.

Figure 10:
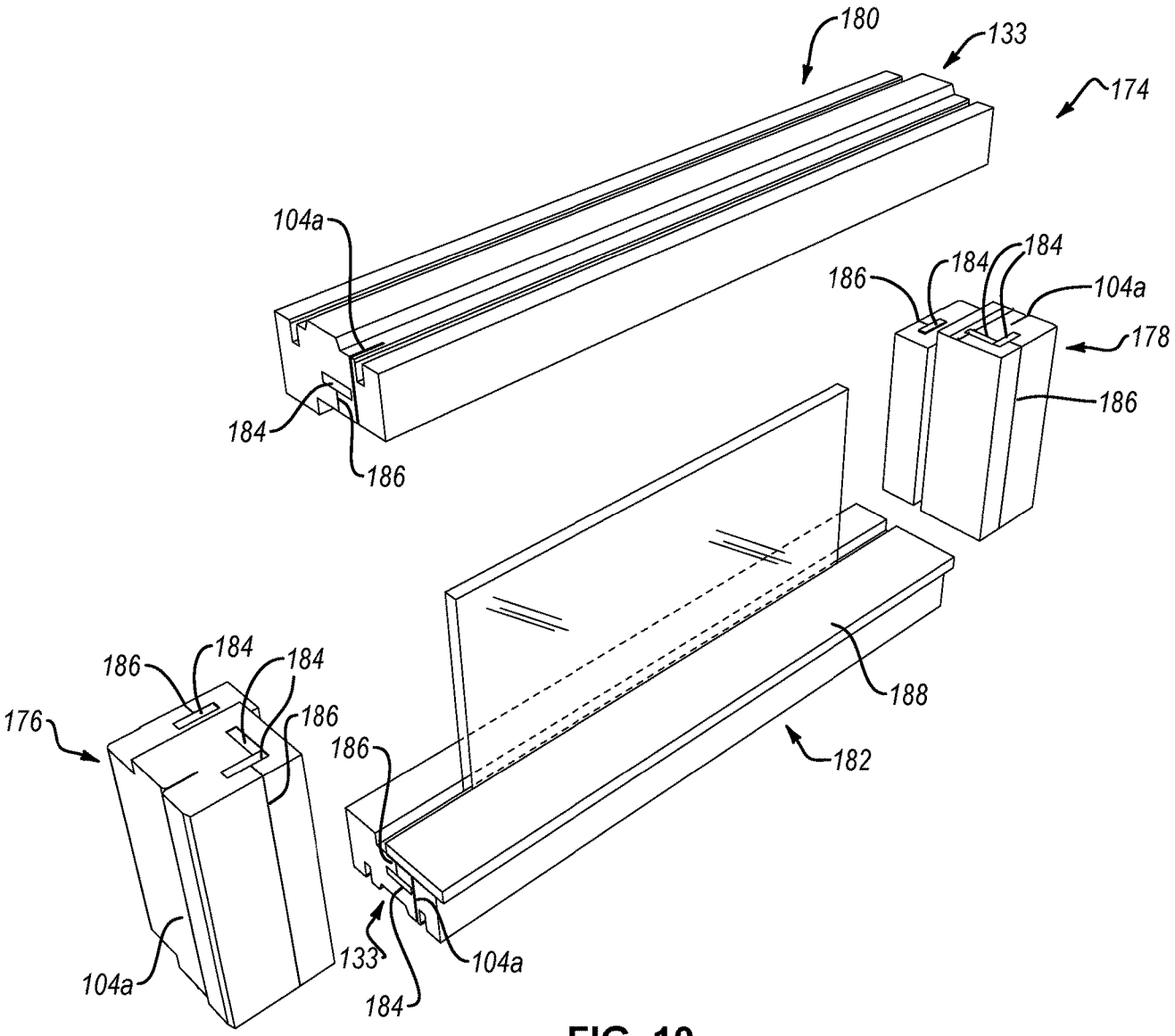

FIG. 10 shows an exemplary window module that can replace one or more of the described panels, so as to position a window within a given "slice". The top, bottom, and left and right sides of the window module provide the same mating features provided in any of the other panels, to allow "plug and play" of such window modules anywhere within the building system, but replacing one or more such panels with the window kit module.

DETAILED DESCRIPTION OF THE PREFERRED EMBODIMENTS

I. Definitions

Some ranges may be disclosed herein. Additional ranges may be defined between any values disclosed herein as being exemplary of a particular parameter. All such ranges are contemplated and within the scope of the present disclosure.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values for example thus include values that are within 20%, 10%, within 5%, within 1%, etc. of a stated value.

All numbers used in the specification and claims are to be understood as being modified in all instances by the term "about", unless otherwise indicated. The use of "about", "substantially" and the like may particularly include values within the above stated variance (e.g., within 20%, 10%, 5%, 1%). Notwithstanding that the numerical ranges and parameters setting forth the broad scope of the subject matter presented herein are approximations, the numerical values set forth in the specific examples are reported as precisely as possible. Any numerical value, however, inherently contains certain errors necessarily resulting from the standard deviation found in their respective testing measurements.

It must be noted that, as used in this specification and the appended claims, the singular forms "a," "an" and "the" include plural referents unless the content clearly dictates otherwise.

Any directions or reference frames in the description are merely relative directions (or movements). For example, any references to "top", "bottom", "up" "down", "above", "below" or the like are merely descriptive of the relative position or movement of the related elements as shown, and it will be understood that these may change as the structure is rotated, moved, the perspective changes, etc.

All publications, patents and patent applications cited herein, whether supra or infra, are hereby incorporated by reference in their entirety to the same extent as if each individual publication, patent or patent application was specifically and individually indicated to be incorporated by reference.

II. Introduction

In one embodiment, the present invention is directed to modular building methods and systems where the building is constructed using lightweight foam modular panels in which the panels are pre-slotted, to include one or more channels formed through the length or width of the lightweight foam body of the panel. The panel can have a geometry where the cross-section is consistent, across its entire length or width (i.e., a geometry that could be extruded). The channels are configured to receive one or both elongate flanges of a corresponding C-channel frame member. In an embodiment, the C-channel frame members are metal (e.g., steel). The flanges and associated channels into which they are received can be configured so that the flanges are not exposed on an outside face of the lightweight body (at least once the construction is finished, if not before), but so that the flange is restrained in the wall, floor, or roof which it forms a part of (e.g., it can only slide in and out of the channel once placed—with 1 degree of freedom).

The system may be configured to provide an interior horizontally or vertically or otherwise positioned I-beam in a wall (or floor or roof) constructed with such panels and C-channel frame members, where each I-beam is positioned between such panels, of adjacent module portions of the building construction. The flanges and web of each I-beam may be formed from back-to-back C-channel frame members, such that the I-beam is not prefabricated, but is actually assembled in-situ, as the panels and C-channel frame members are positioned to build the wall, floor, and/or roof of the building structure. While pre-fabricated I-beam frame members could be used, it is actually an advantage to not employ such (e.g., lighter weight components, ease of construction with placing one C-channel frame member at a time, etc.).

The panels may include channels for additional splines, beyond those that accommodate the flanges of the C-channel frame members, e.g., for insertion of furring strip splines or the like. Such furring strips may be helpful in providing additional attachment points for nails, screws or the like, e.g., for sheathing or other material positioned over the wall, floor, or ceiling.

The modular panels may have a thickness (e.g., foam thickness) that is typically greater than 4 inches, e.g., 5.5 inches, (the same width as a 2×6) or 7.25 inches (the same width as a 2×8). Because the panels include a cross-sectional geometry that is consistent across the length or width of the panel, they provide excellent flexibility in constructing any desired wall structure or building.

The modular panels can be formed on a CNC hot wire cutting device, where all necessary deep cuts are formed (as it can be difficult to accurately cut foam material thicker than about 2 inches without such a device). Because the panels are formed under such conditions, during manufacture, high precision and accuracy are possible (which may not be practical to achieve on a job site). Furthermore, by cutting the panels on such a CNC device, the rectangular panels themselves can be formed to very high precision and accuracy dimensions. For example, a 2 foot by 4 foot, or 2 foot by 8 foot panel, 5.5 or 7.25 inches thick will be perfectly "square" and plumb, allowing the panel itself to be used as a square, level, or jig. This characteristic greatly reduces the need for skilled labor, as the panel and C-channel frame members themselves serve as a template in order to properly align one another (i.e., no tape measure or square is needed). This helps to ensure a robust composite structure having the proper geometry (e.g., right angled walls where such is desired, level floors, level ceilings, and the like).

The present methods and systems of assembly allow for relatively open-source construction, with a relatively high degree of customizability to the building being constructed, all achievable at lower cost and/or time as compared to existing methods of construction. Furthermore, even with such relative flexibility, little if any skilled labor is required. For example, a model, isometric view or blueprint image of the building to be constructed could simply be provided, with the crew only being required to assemble the modules one after another, as shown in the model, isometric view or blueprint (e.g., akin to LEGO instructions).

It is also advantageous that the foam material (e.g., expanded polystyrene, or other foamed insulative materials) from which the modular panels are constructed may be readily available nearly anywhere, such that the foam panels may be manufactured at a foam production facility near the construction site (minimizing shipping distance and expense). This provides savings and convenience in that the foam panels can be manufactured locally, avoiding the significant expense of shipping foam (which occupies a large volume, even though it weights little).

For example, such foam may typically have a density from about 1 lb/ft$^3$ to 2 lb/ft$^3$, and provide an insulative value of about R4 per inch of foam thickness. A wall constructed using a 5.5 inch or 7.25 inch thick foam panel as described herein may provide an R value of about R25 or R30, respectively.

III. Exemplary Construction Methods and Systems

Figure 1A:
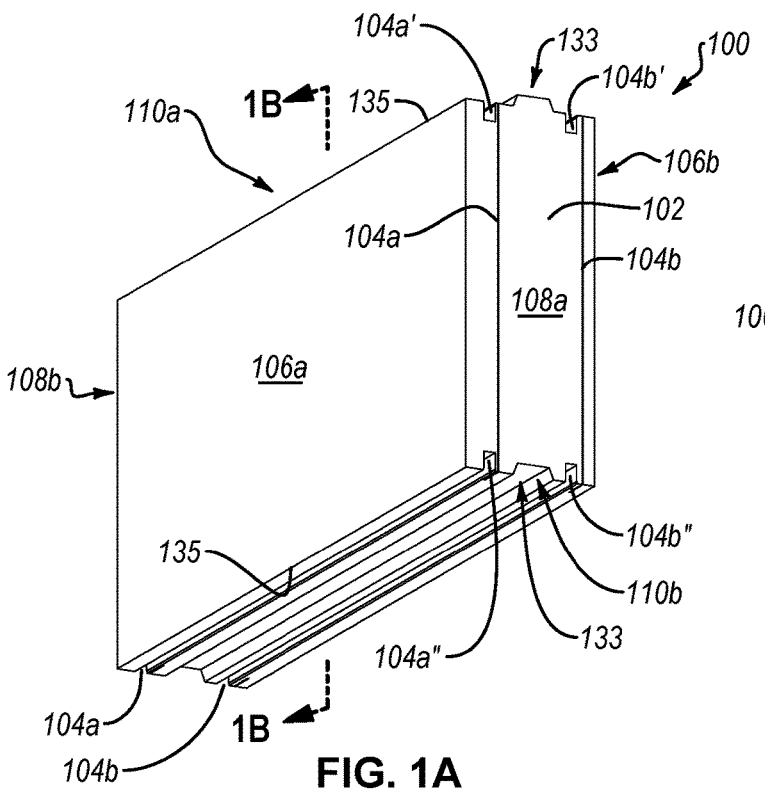
FIGS. 1A-1C show top, bottom, and cross-sectional isometric views respectively, of an exemplary modular panel as described herein, e.g., for use in constructing walls and floors.
Figure 1B:
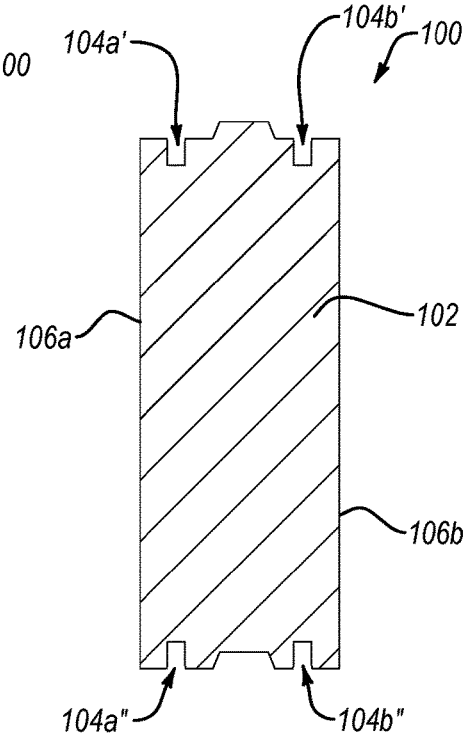
Figure 1C:
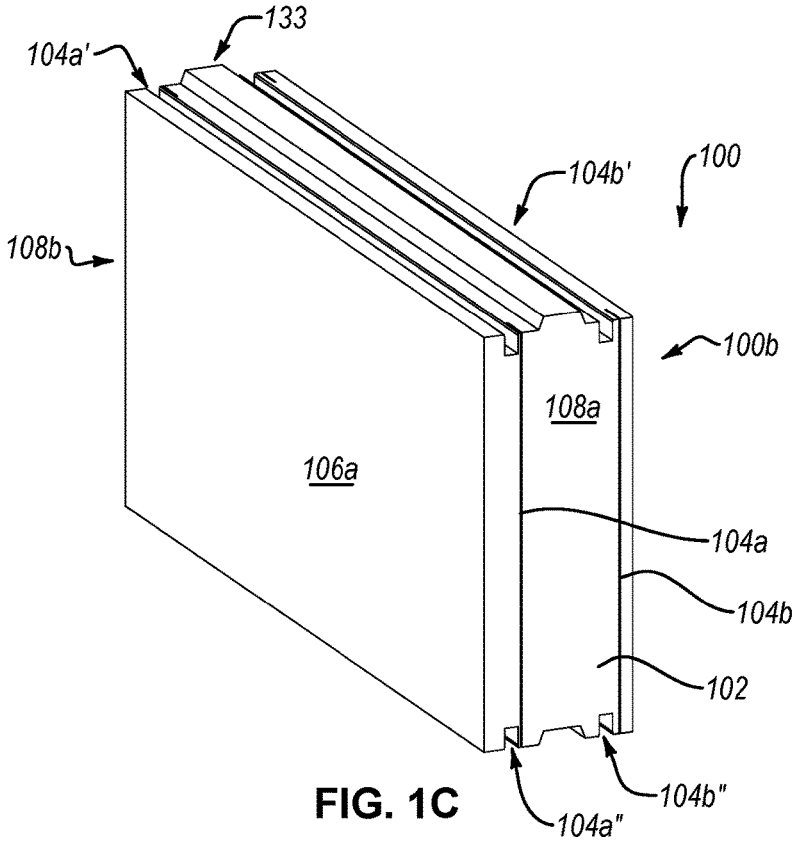

FIGS. 1A-1C show a modular panel 100 according to an embodiment of the present invention. Such panels can be used in building construction, and advantageously are typically fully compatible with existing building codes and standard construction practices, such that adoption of such a building system would not present the many regulatory and other hurdles associated with various other construction systems that have been proposed, some by the present Applicant.

Modular panel 100 includes a lightweight body 102. Body 102 may comprise or otherwise be formed from a foam material, such as expanded polystyrene (EPS) foam. Such material may be rigid. Such panels may be precision cut from blocks of rigid, already cured EPS foam. For example, EPS foam is often available as 3×4×8 foot blocks. Such a block may be sufficient to produce several modular panels as shown in FIG. 1, which may each measure 2×4 feet (or 2×8 feet), with a thickness of 7.25 inches (width of 2×8 dimensional lumber). While EPS foam may be particularly appropriate, other lightweight materials that can be molded (as the 3×4×8 foot EPS blocks are molded), easily cut using CNC hot wire cutting device, formed by extrusion etc., may also be used.

Each panel 100 includes one or more (e.g., a plurality of) channels 104 extending horizontally or vertically through the length (e.g., width) or height of panel 100. The panel also includes first and second (e.g., interior and exterior) panel faces 106*a* and 106*b*, opposing sides 108*a*, 108*b*, a top end 110*a*, and a bottom end 110*b*. In the illustrated configuration, panel 100 includes first and second vertical channels 104*a*, 104*b*, formed into each of opposing sides 108*a*, 108*b*, the channels being positioned off-center relative to the thickness of foam body 102, with channel 104*a* positioned towards (i.e., closer to) panel face 106*a* and channel 104*b* positioned towards panel face 106*b* (i.e., closer to panel face 106*b* than the center of the thickness of foam body 102). In the illustrated embodiment, channels 104*a* and 104*b* are also positioned different distances away from their corresponding panel faces 106*a*, 106*b*, with channel 104*b* being closer to panel face 106*b* than channel 104*a* is to panel face 104*a*. The distance between such channels corresponds to the spacing between the flanges of the C-channel frame members. In another embodiment, rather than including two channels in each side 108*a*, 108*b*, only one vertical channel may be provided, where one flange of the C-channel frame member is received into the single channel (e.g., 104*a*), and the other flange wraps around the opposite edge, between side 108*a*/108*b* and the corresponding panel face 106*b*.

Panel 100 also includes top and bottom channels 104*a*', 104*b*', and 104*a*" and 104*b*", which are each configured to receive a flexible elongate spline (e.g., furring strip). In an embodiment, such splines are advantageously not dimensional lumber, which although readily available, is notorious for being warped, making it difficult to slide such a flange into any of such channels. Rather, any such included splines or furring strips may be formed from oriented strand board ("OSB"), plywood, or another material. Such furring strips may provide excellent attachment points within the panel, e.g., when securing drywall or other sheathing material over one or both panel faces 106*a*, 106*b*.

Any such channels within panel 100 may have dimensions just slightly larger than those of the elongate flange or spline to be received, so as to not bind within the channel, but so as to be freely insertable therein (e.g., a clearance of 1/32 inch or 1/16 inch or so, as will be apparent to those of skill in the art, may be provided). As shown, each of channels 104*a*', 104*b*', 104*a*" and 104*b*' are half-size height, in the top and bottom ends 110*a* and 110*b* of panel 100. Such reduced-size (e.g., half-height) channels are intended to accommodate elongate splines that run through the reduced-size channel (e.g., half height), and another reduced-size (e.g., half-height) channel of an adjacent panel 100 stacked above or below the illustrated panel, when constructing a wall.

In an embodiment, when a flange or spline is received into any of the channels (104*a*, 104*b*, 104*a*', 104*b*', 104*a*" or 104*b*"), the flange or spline is not exposed on either exterior face 106*a* or 106*b* of panel 100. Such a configuration may prevent any ghosting or thermal bridging problem that might otherwise occur. That said, as noted, in an embodiment, where channel 104*b* is not provided, one flange of the C-channel frame members may be received in channel 104*a*, while the other flange wraps around the edge between one of opposing sides 108*a*/108*b* and face 106*b*.

Any of the splines or flanges may be more securely retained within any of the channels with any suitable adhesive. Without use of such an adhesive, the building system may actually be reversible, allowing dis-assembly of the components in a way that allows them to easily and quickly be re-assembled, e.g., at a different time, or in a different location. Such characteristics may be particularly beneficial for temporary structures (e.g., emergency housing, sets for plays or other drama productions, and the like). Where an adhesive is used, such adhesive may be injected into the channel or placed on the splines or flanges, prior to channel insertion. Once drywall or other sheathing is placed over the foam panel faces 106*a* or 106*b*, nails or screws may further be used to secure such sheathing to the splines within any of such channels.

While the panels may be provided in lengths of 4 or 8 feet or any other desired length, they are easily cut, e.g., using a conventional circular saw (e.g., with a deep blade). They can easily be cut before insertion of any spline flanges and/or I-beams (in which case one is simply cutting through foam).

While shown with straight planar walls, it will be appreciated that curved walls are also possible, e.g., by providing closely spaced (e.g., 6 inches or less, 4 inches or less, 3 inches or less, or 2 inches or less, such as 1 inch spacing) pre-cut slits into at least one face of the panel that is to be used in forming a curved wall. Such slits would allow the panel to be flexed, creating a curved continuous face along the opposite major planar face. Such slits could of course be filled in on the cut face, for finishing, if desired.

All components and steps of the method and system can be handled without heavy equipment (e.g., cranes). In fact, the modular panels and C-channel frame members are so light as to be easily handled and positioned by a crew of women. For example, the panels (e.g., 2 feet×4 feet) may weigh less than 40 lbs, less than 30 lbs, less than 20 lbs, or less than 15 lbs. A 2 foot×8 foot panel weighs only about 6-7 lbs, and a 2 foot by 4 foot panel weighs even less. Corresponding metal C-channel members similarly may weigh less than 15 lbs, or less than 10 lbs each.

Figure 1D:
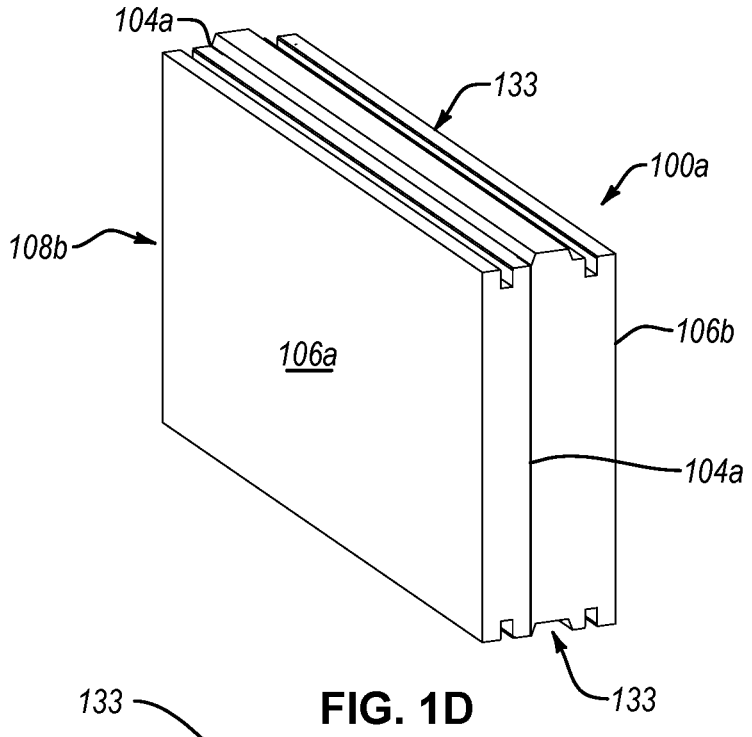
FIG. 1D shows an alternative panel similar to that of FIGS. 1A-1C, but which includes only a single pre-slotted channel formed therein to receive a flange of the C-channel frame member.
Figure 1E:
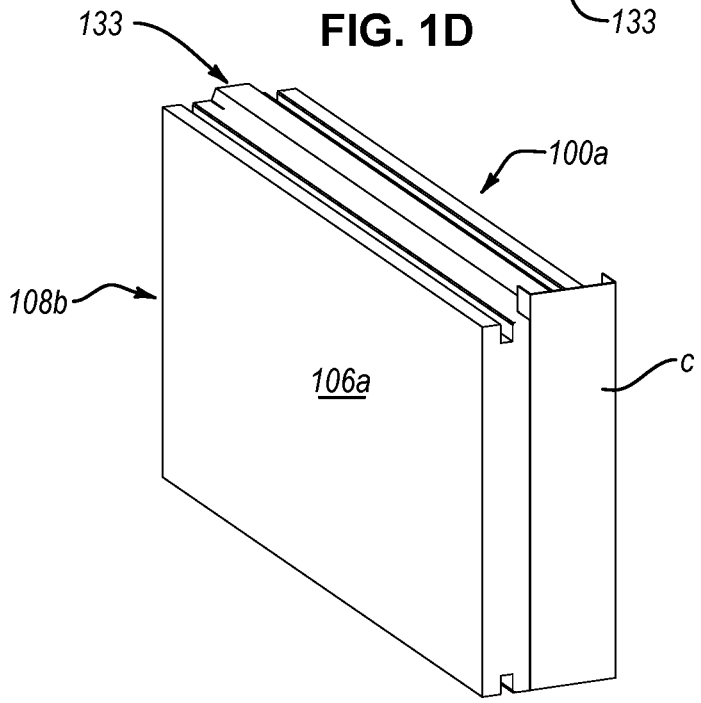
FIG. 1E shows the panel of FIG. 1D, with one of the flanges of the C-channel received into the single flange-receiving slot of the modular panel in a given side of the panel, and the other of the flanges wrapping around the edge of the panel.

FIGS. 1D-1E shows a similar foam panel 100*a*, which is similarly configured to panel 100 of FIGS. 1A-1C, but where panel 100*a* only includes a single channel 104*a* in each of the right and left sides 108*a*/108*b* of the panel, so that as shown in FIG. 1E, one flange 116 of the C-channel frame member C is received into channel 104*a*, and the other flange 116 wraps around the edge of the panel, towards face 106*b* of such panel.

In either the configuration of FIGS. 1A-1C, or that of FIGS. 1D-1E, an important advantage is that an "ear" portion of the panel, received into C-channel frame member C is fully engaged with the C-channel frame member, between flanges 116. The space between flanges 116 is thus filled with the foam panel ear, ensuring that if such an ear portion of the panel is pressed on in this configuration, the ear is not under tension (which would cause it to break off with moderate pressure), but is under compression, because this ear portion is positioned between the flanges 116 of the C-channel frame member.

Both illustrated panels 100 and 100*a* include a stair-stepped configuration 133 at the top and bottom ends 110*a*/110*b* of the panel, where adjacent panels mate to one another, which prevents water from entering at what might otherwise be a simple horizontal seam between stacked foam panels. Such a stair-stepped or inclined surface or interface can be provided at the interface of all panels attaching to one another, whether one standard panel to another standard panel (as in a wall, floor, or roof), or a transition panel attaching to a standard panel. In other words, the top and bottom ends of each panel include a stair stepped configuration at 133, so that the horizontal seam 135 is followed by an inclined or stair-stepped surface, preventing water from seeping in between stacked panels.

Figure 2A:
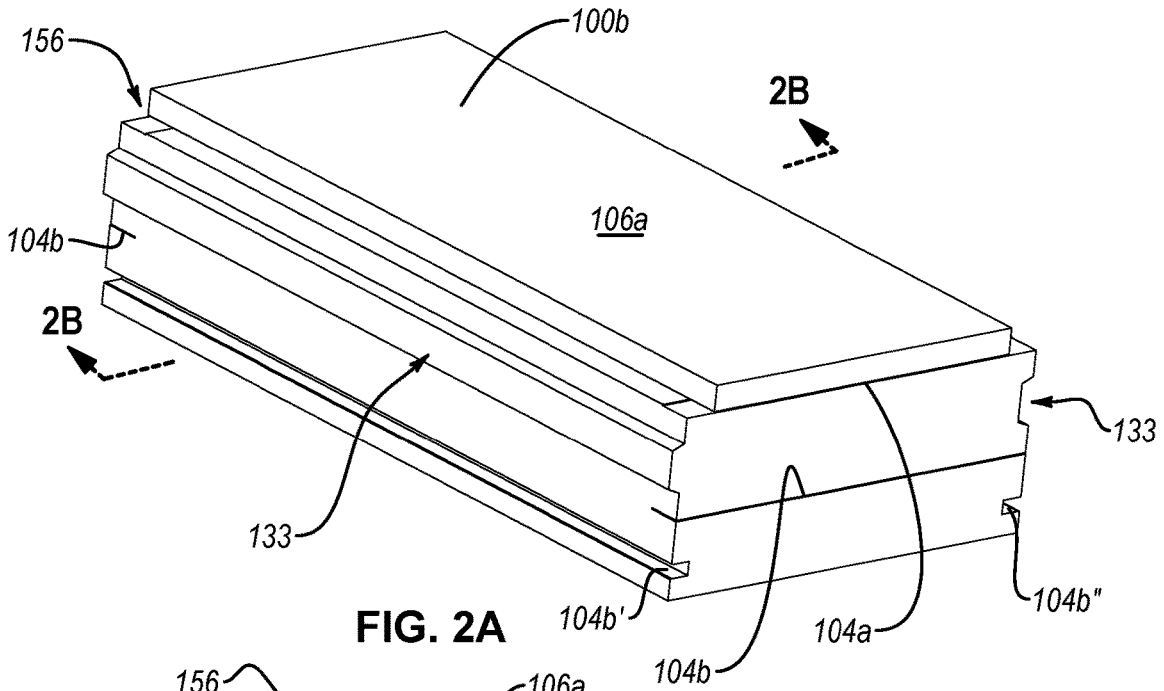
FIGS. 2A-2C show various views of an exemplary roof panel. The modular roof panel of FIGS. 2A-2C may be substantially identical to the modular panel of FIGS. 1A-1C, other than the purlin channel included in the top of the illustrated modular roof panel, and elimination of one of the furring strip channels. Other minor differences may also exist.
Figure 2B:
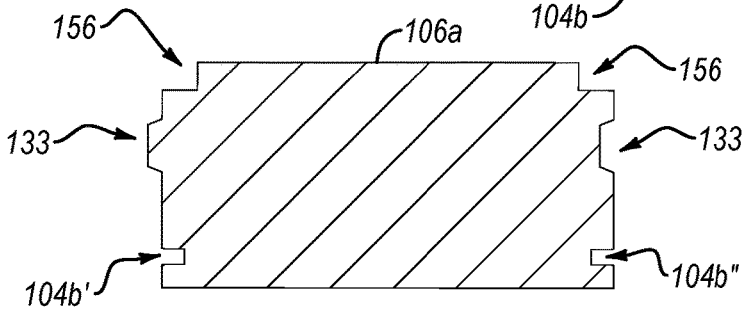
Figure 2C:
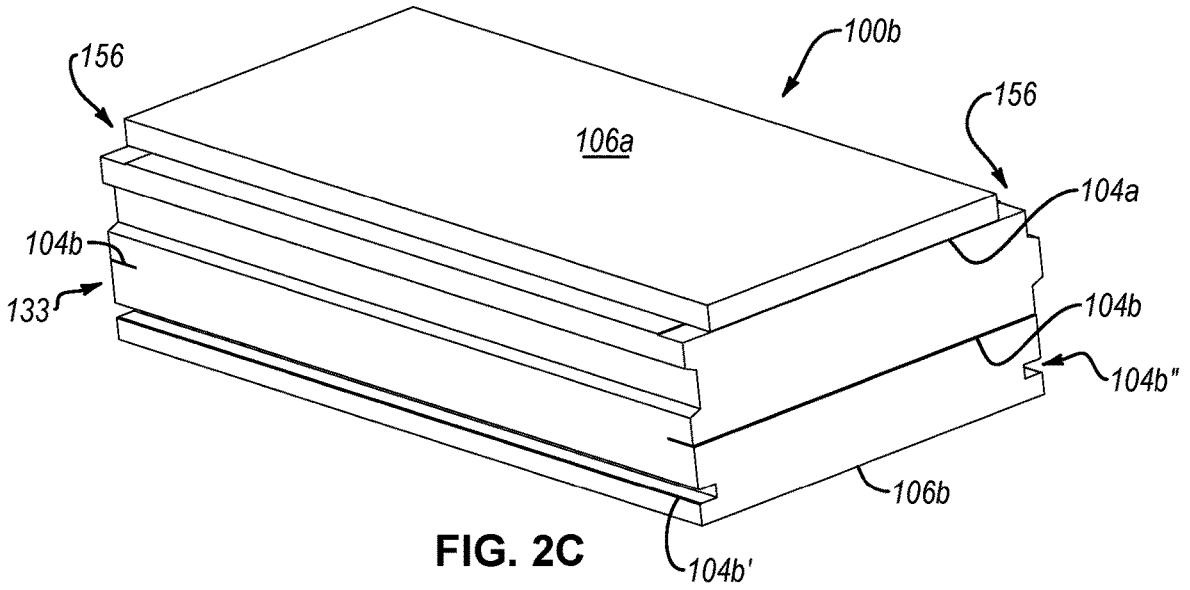

FIGS. 2A-2C show another foam modular panel 100*b* similar to the panel 100 shown in FIGS. 1A-1C, but which includes an optional purlin channel 156 in the top major planar face 106*a* of the panel. The roof panel 100*b* is also shown as thicker than the wall panel 100, and without furring strip channels 104*a*' and 104*a*". The bottom major planar face 106*b* may not include any such purlin channel, but may be entirely planar. Such panels may be employed as roof panels in constructing a building, if desired.

Any desired roof pitch may be accommodated by such construction. Exemplary pitches include any desired pitch ratio, such as from 12/1 to 12/18 (e.g., 12/1; 12/2, 12/3; 12/4; 12/5; 12/6; 12/7; 12/8; 12/9; 12/10; 12/11; 12/12; 12/13; 12/14; 12/15; 12/16; 12/17; or 12/18). A flat roof is of course also possible.

Figure 3A:
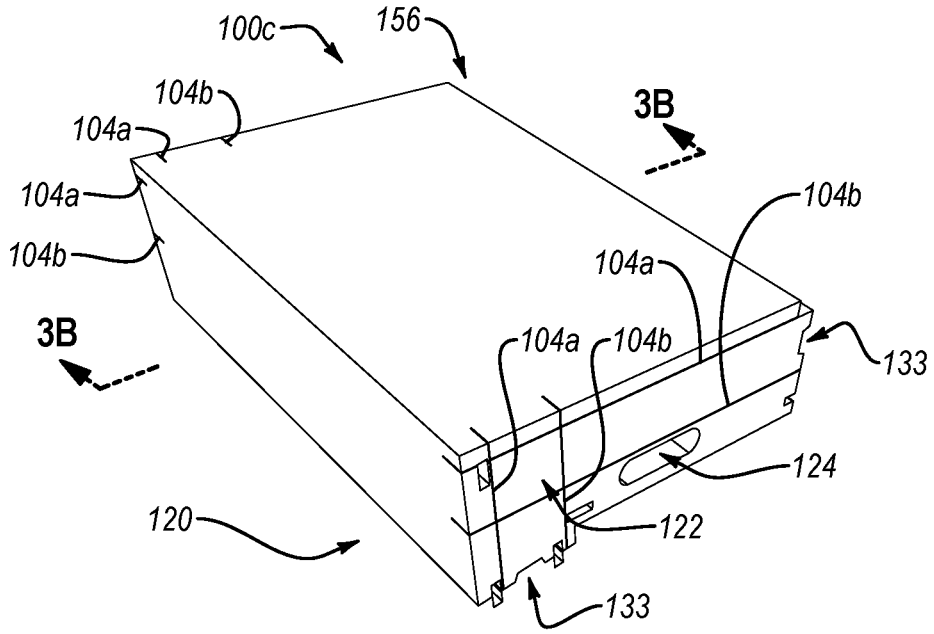
FIGS. 3A-3C show various views of an exemplary wall-to-roof transition panel.
Figure 3B:
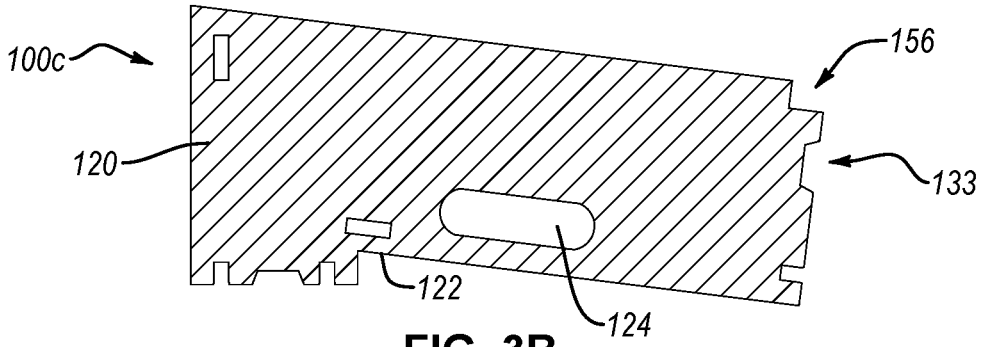
Figure 3C:
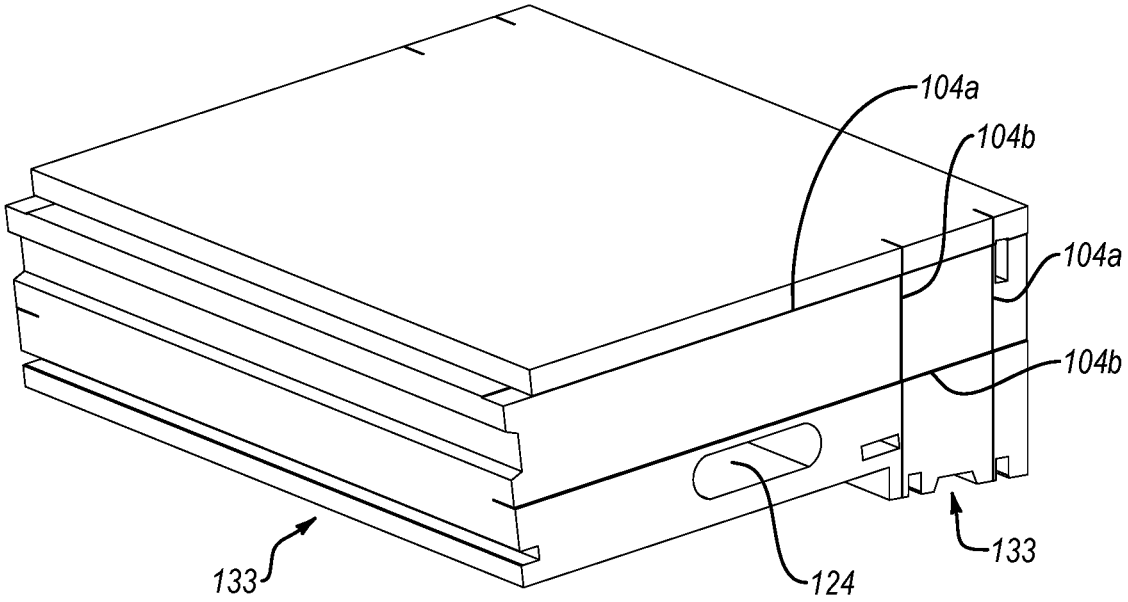

FIGS. 3A-3C show various views of an exemplary modular wall-to-roof transition panel 100*c*, as may be used for transitioning from wall to roof sections in a desired building construction. Wall-to-roof transition panel 100*c* may be described as including 2 portions—a wall leg 120 that mates with the adjacent top-most wall panel (e.g., panel 100) of the wall being constructed; and a roof leg 122 that mates with the adjacent first roof panel (e.g., panel 100*b*) of a pitched, slanted or other roof being constructed. Eaves may be provided by the roof C-channel frame members, as shown in the other Figures. In another embodiment, an eave portion may be provided within the wall-to-roof transition panel 100*c*. It will be apparent that the length of the wall leg and the length of the roof leg can be independently specifically selected as needed, to accommodate a desired wall height, as well as to accommodate a desired roof plane length. Alternatively, any needed length in the wall or roof may be made up, by providing a shorter or longer roof or wall panel. As shown, the thickness of the roof leg may be greater than the thickness of the wall leg (e.g., given a thicker foam roof than foam walls). FIGS. 3A-3C illustrate how the mating ends of the roof leg 122 and the wall leg 120 of the wall-to-roof transition panel 100*c* include the same stair-stepped configuration 133 as the other panels, so as to mate with the corresponding stair-stepped configuration of any other desired roof panel or wall panel. A purlin portion 156 is also shown in the roof leg portion of transition panel 100*c*, e.g., where such transition panel may be used with the roof panel 100*b* including such perlins 156, e.g., as shown in FIGS. 2A-2C.

Each of the wall leg 120 and the roof leg 122 further includes pre-slotted channels 104*a* and 104*b*, so as to axially align with the corresponding flange-receiving channels 104*a* and 104*b* in the corresponding wall and roof panels 100 and 100*b*, as well. For example, as shown, the wall leg 120 includes vertical channels 104*a* and 104*b*, which align with the same flange-receiving channels of the adjacent top-most wall panel 100. Similarly, roof leg 122 includes substantially horizontal channels 104*a* and 104*b*, which align with the same flange receiving channels of the adjacent roof panel 100*b*.

Wall-to-roof transition panel 100*c* is also shown as including a ducting plenum 124 formed into the foam of the roof leg 122 of the wall-to-roof transition panel 100*c*, to make a continuous insulated HVAC duct that runs continuously along the length of successive "slices" of a building structure constructed using such panels. Vents into the ducting plenum 124 can simply be cut at any desired location. It is also possible to connect formed ducting on opposite sides of the building, by installing, e.g., plastic piping that is inserted into slots that could be cut into each foam panel forming the ceiling, so as to create a path perpendicular relative to the pre-formed ducts 124. Since each "slice" of the structure is a repeat of the previous "slice", continuous runs can be created. Between foam panels, gaskets or a sealant can be used between "slices" as each cross-sectional "slice" of the structure is installed.

Figure 4A:
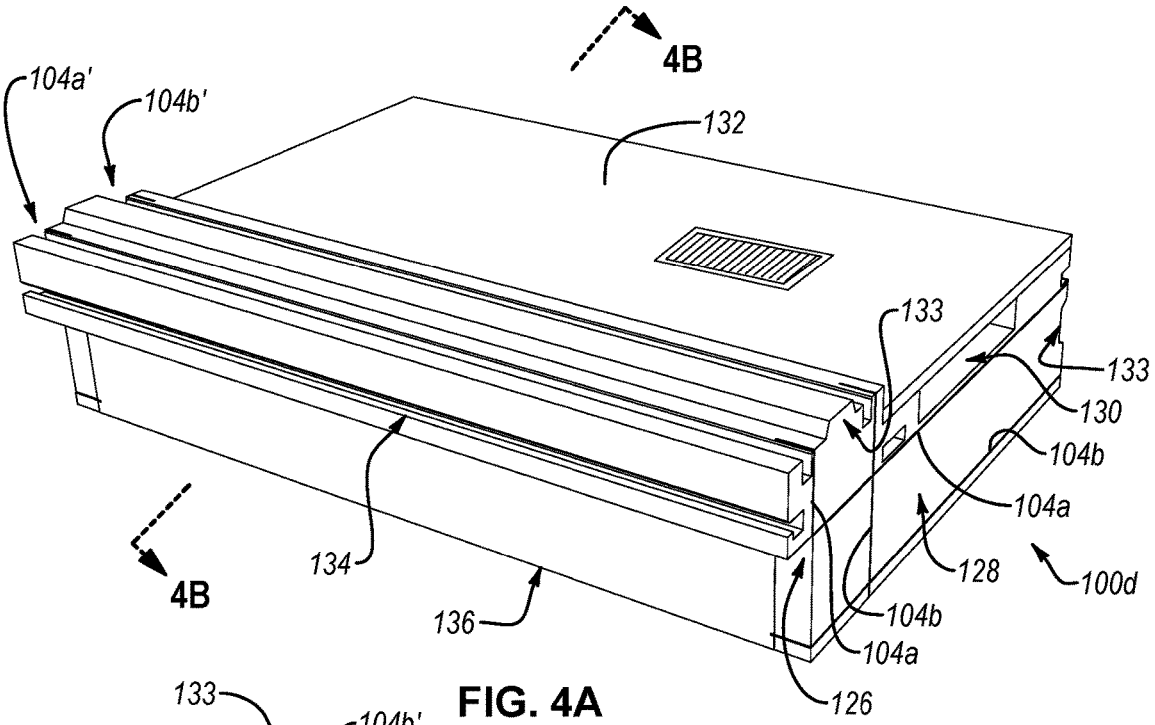
FIGS. 4A-4C show various views of an exemplary wall-to-floor transition panel.
Figure 4B:
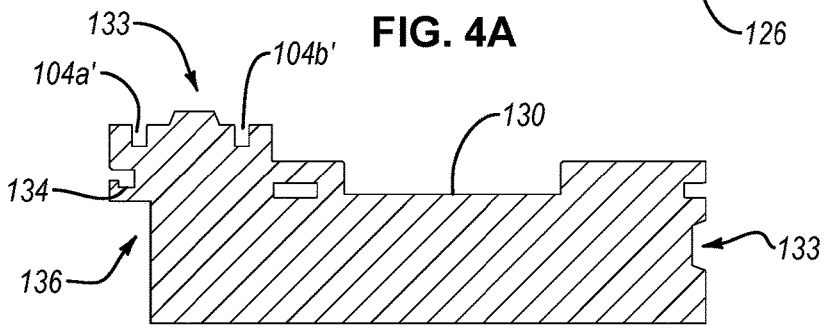
Figure 4C:
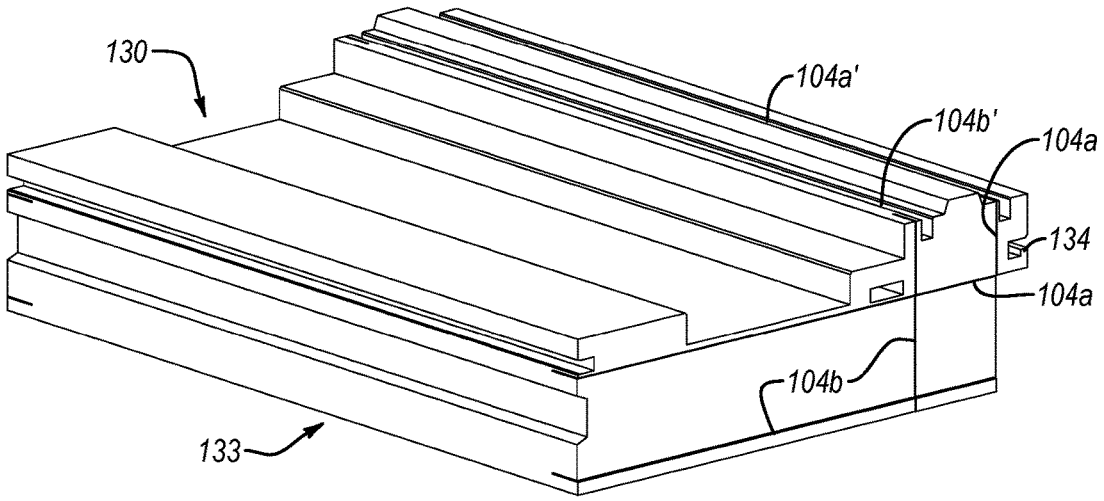

FIGS. 4A-4C show various views of an exemplary modular wall-to-floor transition panel 100*d*, as may be used for transitioning from wall to floor sections in a desired building construction. Wall-to-floor transition panel 100*d* may be described as including 2 portions—a wall leg 126 that mates with the adjacent bottom-most wall panel (e.g., panel 100) of the wall being constructed; and a floor leg 128 that mates with the adjacent first floor panel (e.g., same or similar to a standard wall panel 100) of a floor being constructed. It will be apparent that the length of the wall leg and the length of the floor leg can be independently specifically selected as needed, to accommodate a desired wall height, as well as to accommodate a desired floor plane length. Alternatively, any needed length in the wall or floor may be made up, by providing a shorter or longer floor or wall panel. FIGS. 4A-4C illustrate how the mating ends of the floor leg 128 and the wall leg 126 of the wall-to-floor transition panel 100*d* include the same stair-stepped configuration 133 as the other panels, so as to mate with the corresponding stair-stepped configuration of any other desired floor panel or wall panel.

Each of the wall leg 126 and the floor leg 128 further includes pre-slotted channels 104*a* and 104*b*, so as to axially align with the corresponding flange-receiving channels 104*a* and 104*b* in the corresponding wall and floor panels 100 (or 100*a*), as well. For example, as shown, the wall leg 126 includes vertical channels 104*a* and 104*b*, which align with the same flange-receiving channels of the adjacent bottom-most wall panel. Similarly, floor leg 128 includes horizontal channels 104*a* and 104*b*, which align with the same flange-receiving channels of the adjacent floor panel.

Wall-to-floor transition panel 100*d* is also shown as including a ducting plenum 130 formed into the foam of the floor leg 128 of the wall-to-floor transition panel 100*d*, to make a continuous insulated HVAC duct that runs continuously along the floor length of successive "slices" of a building structure constructed using such panels. Holes can be cut into the subfloor 132 at any location along the length of such a plenum 130, for floor vents into the structure. A furnace may be installed directly over such a preformed duct plenum 130. Such a feature is advantageous, for reducing the work required for HVAC ducting, etc. As with the ducting plenum described in conjunction with the wall-to-roof transition panels, since each "slice" of the structure is a repeat of the previous "slice", continuous runs of such ducting in roof and floor can be created. Between foam panels, gaskets or a sealant can be used between "slices" as each cross-sectional "slice" of the structure is installed. While FIGS. 4A-4C show the wall-to-floor transition panel with the ducting plenum open at the top face of the panel, and FIGS. 3A-3C show the wall-to-roof transition panel with the ducting plenum closed at the top face of the panel, it will be apparent that either of such configurations may be used at either location.

FIGS. 4A-4C also illustrates how an electrical cable tray 134 can be cut into the foam of the wall leg 126 of the wall-to-floor transition panel 100*d*. Such a tray 134 may accept electrical wires that can be installed on the exterior of the building or a given wall prior to application of a finish material (e.g., brick, siding, stucco, drywall, etc.). One may simply drill or cut through the foam to the interior, to move wires into interior electrical boxes. The raceway is shown as located in the portion of the foam that bypasses the C-channel structural members (thermal break area) so holes do not need to be drilled through structural steel of the C-channel frame members. However, raceways can be installed in other locations of the foam, and pre-punched holes can be formed into the steel to allow continuous raceways, if desired.

As shown, the bottom of the wall leg 126 forms a ledge with a recessed lower portion 136, into which the C-channel frame member skirt can be received, as will be seen in the following Figures. The cantilevered portion of the foam into which tray 134 is formed may thus rest on top of, and be supported by such skirt.

The very simple method of construction made possible using wall panels such as that shown in FIGS. 1A-1C, in combination with the described roof panels, wall-to-floor and wall-to-roof transition panels shown in FIGS. 2A-4C will now be described.

Referring to 5, for small structures, a steel skirt 138 can be installed, or a floor can be provided (e.g., step 1). A first frame 140 partially defining the floor, a wall and roof can be formed, as shown in FIG. 5 (e.g., step 2). Such a first frame 140 is assembled from the illustrated C-channel frame members, e.g., a C-channel frame member for the floor, one for the roof, and one for each of the vertical walls. The pre-slotted foam panels 100, as well as the pre-slotted transition panels (wall-to-floor transition panel 100*d* and wall-to-roof transition panel 100*c*) may then be slid into the first frame (e.g., step 3), as indicated by arrow 137. In particular, the flanges of the C-channel member are slid into the channels 104*a*, 104*b* of each panel. In an embodiment, the floor panels may be slid in first, followed by the wall panels and then the roof panels. As shown in FIG. 5, where 4-foot wide panels are used, this results in a 4-foot wide module or "slice" of the building construction being assembled, with walls, floor, and roof. Once the panels have been mated into the flanges of the C-channel members of the frame, another series of C-channel frame members are inserted into the placed foam panels as indicated by arrow 139, forming a second frame (step 4). Such C-channel members are inserted into the channels 104*a* and 104*b* formed into the opposite side of each of the wall, floor, and roof panels 100, 100*d*, 100*b* and 100*c*. Steps 2-4 result in a completed "slice" or module portion of the overall structure being constructed. Such steps are simply repeated over, as many times as needed, to construct the desired building, building it one "slice" at a time. For example, FIG. 5 indicates placement of another "first" frame 140*a*, back-to-back against the previously positioned second frame 142, at arrow 141.

As noted, in repeating step 2 again (the forming of a first frame), the other "half" of the floor, wall and roof steel C-channel frame members needed to form an I-beam configuration are installed, back-to-back relative to the earlier installed C-channel frame members, that were installed in step 4 (forming the second frame). The right side of FIG. 5 shows the first assembled module "slice" 144. Construction of the building can proceed by simply repeating such steps 2-4 over again and again, until as many modules as needed are assembled, one adjacent to the other, to build the desired building construction.

Turning to FIG. 6, all connections at floor to wall, and wall to roof, between connecting C-channel frame members, are overlap connections, as shown. For example, at 146 is shown an overlap joint or connection. Alignment holes 148 are pre-punched in the steel frame members at transition locations to facilitate accuracy of installation. When the (e.g., circular) holes of the different frame members line up, it is confirmation to the user that the frame members are properly positioned. For example, the roof C-channel frame member 150 of first frame 140*a* is shown as including alignment hole 148, which is positioned back-to-back relative to vertical wall C-channel frame member 152 of second frame 142, which includes a corresponding alignment hole formed therein. When the two C-channel frame members 150 and 152 are properly aligned, the alignment holes 148 both line up, allowing the user to see the underlying foam of foam panel 100*c* through such alignment hole, confirming to the user that the C-channel frame members are properly aligned. Such alignment holes can be provided at each of the overlap connections between the wall C-channel frame member and the roof C-channel member, as well as between the wall C-channel frame member and the floor C-channel frame member, as will be apparent.

FIG. 6 further shows how the two C-channel frame members 154 and 150 shown forming the roof portion of the back-to-back second frame 142 and first frame 140*a* are of the same length, but offset from one another, as shown, providing eaves. The hole 148 in C-channel frame member 150 is aligned with a similarly shaped hole formed in the C-channel frame member 152. An overlap joint is provided between C-channel frame member 150 and 152, as shown, while C-channel frame member 150 rests on top of C-channel frame member 158. In a similar manner, C-channel frame member 154 includes an alignment hole that is aligned with another alignment hole of C-channel frame member 160, while C-channel frame member 154 rests on top of C-channel frame member 162. An overlap connection is formed between C-channel frame member 154 and 162. Similar overlap connections are formed between the other C-channel frame members (e.g., an overlap connection between the wall C-channel frame members 158 and the floor C-channel frame member 164, as well as between wall C-channel frame member 162 and floor C-channel frame member 166.

Both halves of wall, and floor steel C-channel members are typically of the same length, and are just offset to facilitate the overlap connection. The offset overlap connection reduces the number of differently configured steel pieces. If the structure has no eaves, then the two roof steel members can be the same length, and simply offset the width of the wall members. By offsetting, this ensures correct orientation of the placement of the steel C-channel members as one installs opposite sides so that the eaves bypass correctly. This method makes it so the steel can only be installed one way, eliminating or reducing installation mistakes.

FIG. 7A illustrates how the floor-to-wall transition panels can have customizations cut into the foam as shown, where a heating and/or cold air return duct 130 can be formed into the foam, to move heating or cooling air. In successive slices of the building these will connected to one another, forming a continuous duct along the length of the building. Holes can be cut into the subfloor 132 at any location along the length of such a ducting plenum 130, for vents into the structure. A furnace may be installed directly over such a preformed duct. Such a feature is advantageous, for reducing the work required for HVAC ducting, etc.

FIG. 7A illustrates a close-up of the lower portion of building construction, showing the electrical cable tray 134 cut into the foam of a given panel to accept electrical wires that can be installed on the exterior of the building prior to application of a finish material (e.g., brick, siding, stucco, etc.). One may simply drill or cut through the foam to the interior, to move wires into interior electrical boxes. The raceway 134 is in the portion of the foam that bypasses the structural members (thermal break area) so holes do not need to be drilled through structural steel of the C-channel frame members. However, raceways can be installed in other locations of the foam, and pre-punched holes can be formed into the steel to allow continuous raceways, if desired.

FIG. 7B is a zoomed-out view, similar to FIG. 7A, showing how ducting can be formed into the foam, e.g., of both the wall-to-roof and wall-to-floor transition panels, to make a continuous insulated duct that runs continuously along the length of successive "slices" of the building structure. Vents into the plenum of the ducting can simply be cut at any desired location. In particular, FIG. 7B shows the roof plenum 124, as well as the floor plenum 130.

FIG. 7C shows a similar, close-up view, of the top roof or ceiling portion, showing the roof ducting plenum 124. As shown, holes 168 can be drilled or cut at any desired location, to facilitate an HVAC vent into roof ducting plenum 124. It is also possible to connect formed ducting on opposite sides of the building, e.g., by installing plastic piping that is inserted into slots that are cut into each foam panel, so as to create a path perpendicular to the pre-formed ducting 124. Since each "slice" of the structure is a repeat of the previous "slice", continuous ducting runs can easily be created. Between foam panels, gaskets or sealant can be installed as each cross-sectional "slice" of the structure is installed.

FIG. 8 illustrates how on larger structures where wall steel C-channel members are long and cumbersome, the complete floor can be installed first, with small pieces of vertical steel C-channel (i.e., stubs 170) sticking up vertically. This forms an overlap connection when upper offset wall steel members are placed in position. This has several advantages, such as the below.

(1) The completed floor is stable and holds the small piece of vertical steel 170 securely in the precise desired location since the foam floor panels act as a precision jig.

(2) The tall vertical members (e.g., 158, 160, 162) can easily be plumbed and then screws into the overlap connection will lock the vertical members into plumb position. Again, walls and roof are installed in complete "slices" prior to moving onto successive "slices" as illustrated in the 3-step method (steps 2-4 identified herein, repeated).

(3) Prior completion of the floor (e.g., including OSB or similar subfloor 132) makes a good working platform to move ladders or scaffolding while installing each slice of the structure.

(4) This same method can be used to install successive stories (e.g., $2^{nd}$ level, $3^{rd}$ level, etc.) of a building.

Alignment holes may be provided within such stubs, e.g., for alignment with the adjacent vertical wall member. For example, such an overlap connection is perhaps best apparent where vertical C-channel frame members 162/160 are lowered down, to provide an overlap connection between stub 170 and wall vertical C-channel frame member 162. Of course, any back-to-back C-channel frame members (e.g., such as 160 and 162) can be screwed or otherwise secured together as well, while or once the first frame including C-channel frame member 160 is installed.

FIG. 9 shows how all the building components, e.g., foam panels 100, 100*b*, 100*c*, 100*d*, steel C-channel members "C", and other items such as window kits can be flat packed on a pallet 172. All components are flat packed in layers, such that as the pallet is unpacked, the pieces are on the top, accessible at the top of the pallet load in the order needed for installation.

FIG. 9 also shows an exemplary window kit 174, which includes two foam sides 176, 178, and top and bottom foam pieces 180, 182 that have standard mating profiles to "plug and play" into the building system. Each slice of the building could have mating compatible kits, such as window kits that replace one or more of the panels in a given "slice". Since each "slice" is flat packed, the installer has much less chance of installing wrong items in a given slice. In other words, each "slice" may be flat packed on its own pallet. The installer can be provided with an isometric drawing, to visually facilitate correct installation (e.g., akin to LEGO instructions).

FIG. 10 shows an exploded view of an exemplary window kit 174. As shown, the foam on each element 176, 178, 180, 182 can be cut with similar slot features as the other foam panel components, which the window kit integrates with. Additional slots 184 may also be provided that accept a nailing spline (furring strip), to facilitate attachment of finish materials (e.g., window sills, drywall, etc.) As shown, at each nailing spline location a score line 186 can be cut into the foam so that the location of where the spline is located is apparent to the installer of exterior and interior finish materials, even when the spline itself is hidden within the window kit elements.

Each foam component 176, 178, 180, 182 has a slot 104*a* cut into it so that it will integrate with the steel frame of the structure in the same way that a standard foam panel does, to ensure proper alignment with other foam panels in the system.

Exterior jamb material can be attached to the interior splines in channels 184 to retain the window unit. If the window needs to be replaced in the future, then the jamb material can simply be removed and replaced with a replacement window unit. A sill 188 can be attached, as shown.

Each of the four foam pieces 176, 178, 180, 182 that form the foam window frame are made so a flange is formed so that the window unit is simply pushed against to facilitate proper location of the window unit. Since the foam elements are precision machined, the opening that accepts the window unit is square and provides a tight fit, therefore not requiring any shimming of the window unit.

The window glass can simply be an insulated glass unit, and does not require a frame when the window is a non-operable unit (does not open), thus reducing cost significantly. Such a configuration is also more energy efficient, as there is no thermal loss as occurs through a typical frame. The foam components 176, 178, 180, 182 basically become the frame. However, a normal operable window with a frame can also be installed, in the same manner.

While the Figures illustrate construction of simple exemplary walls and buildings to illustrate concepts of the present construction methods and systems, it will be appreciated that the methods and systems may be used to construct a nearly endless variety of buildings.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope. Additionally, as used in this specification and the appended claims, the singular forms "a," "an" and "the" include plural referents unless the context clearly dictates otherwise.

The invention claimed is:

1. A method for constructing a building from a plurality of C-channel frame members, a plurality of standard modular wall panels, a plurality of wall-to-floor transition panels, and a plurality of wall-to-roof transition panels, the method comprising:

(i) laying down a floor or skirt;

(ii) forming a first frame at least partially defining the floor, a wall, and a roof, the first frame comprising a plurality of C-channel frame members;

(iii) sliding pre-slotted standard wall foam panels, pre-slotted wall-to-floor transition foam panels, and pre-slotted wall-to-roof transition foam panels into the C-channel frame members of the first frame;

(iv) forming a second frame also at least partially defining the floor, the wall, and roof, the second frame being formed by inserting a plurality of C-channel frame members into an opposite end of the pre-slotted standard wall foam panels, the pre-slotted wall-to-floor transition foam panels, and the pre-slotted wall-to-roof transition foam panels of (iii);

(v) repeating steps (ii) through (iv) one or more times to construct the building.

2. A method as recited in claim 1, wherein the method assembles the building as a plurality of standardized width module "slices", one after another.

3. A method as recited in claim 2, wherein the method assembles the building as a plurality of 4-foot width module "slices", one after another.

4. A method as recited in claim 1, wherein the first frame defines an endwall at an end of the building.

5. A method as in claim 1, wherein the standard wall foam panels or specialized roof panels are used to form the roof, attaching to the C-channel frame members at least partially defining the roof.

6. A method as in claim 1, wherein the standard wall foam panels or specialized floor panels are used to form the floor, attaching to the C-channel frame members at least partially defining the floor.

7. A method as in claim 1, wherein the building is constructed to include back-to-back C-channel frame members, forming I-beams, between adjacent module "slices" of the building.

8. A method as in claim 7, wherein the I-beams are not provided integrally, as a single piece, but as separate C-channel members, increasing ease of handling and placement of such I-beams, between adjacent module "slices" of the building.

9. A method as in claim 1, wherein the pre-slotted foam panels include two channels extending along their length or width, two flanges of the C-channel frame members being engaged therein.

10. A method as in claim 1, wherein the pre-slotted foam panels include a channel extending along their length or width, one flange of the C-channel frame members being engaged therein, while another flange of the C-channel frame members wraps around an edge of the pre-slotted foam panels.

11. A method as in claim 9, wherein a space between the flanges of the C-channel frame members is filled with a body of the pre-slotted foam panels, ensuring that forces applied to the panels place that portion of the panel in between the flanges of the C-channel frame member in compression, rather than in tension.

12. A method as in claim 1, wherein top and bottom ends of the pre-slotted foam panels include a stair stepped or inclined configuration, so that when stacking one pre-slotted foam panel atop or adjacent another pre-slotted foam panel, a substantially horizontal or substantially vertical seam therebetween is defined by an inclined or stair-stepped surface interior to the seam, so as to minimize or prevent water seepage between stacked pre-slotted foam panels.

13. A method as in claim 1, wherein the C-channel frame members include alignment holes formed therein, the alignment holes becoming aligned when the C-channel frame members are properly aligned with one another, to form overlap connections of the first frame or the second frame.

14. A method as in claim 1, wherein the floor is provided with vertical C-channel stubs, configured to align with and provide an overlap connection with C-channel frame members of the walls.

15. A method as in claim 1, wherein vertical C-channel frame members of the walls are provided with an overlap connection with C-channel frame members of the floor.

16. A method as in claim 1, wherein vertical C-channel frame members of the walls are provided with an overlap connection with C-channel frame members of the roof.

17. A method as in claim 1, wherein a window kit replaces one or more of the pre-slotted foam panels to integrate a window into the building.

* * * * *